US005529047A

United States Patent [19]

Aota et al.

[11] Patent Number: 5,529,047

[45] Date of Patent: Jun. 25, 1996

[54] AIR-FUEL RATIO SYSTEM FOR AN INTERNAL COMBUSTION ENGINE

[75] Inventors: Hiroyuki Aota, Kariya; Junya Morikawa, Kasugai, both of Japan

[73] Assignee: Nippondenso Co., Ltd., Kariya, Japan

[21] Appl. No.: 390,124

[22] Filed: Feb. 17, 1995

[30] Foreign Application Priority Data

| | | | |
|---|---|---|---|
| Feb. 21, 1994 | [JP] | Japan | 6-022405 |
| Mar. 18, 1994 | [JP] | Japan | 6-049036 |
| Mar. 18, 1994 | [JP] | Japan | 6-049037 |

[51] Int. Cl.[6] ..... F02D 41/14; F02M 25/08

[52] U.S. Cl. ..... 123/674; 123/698

[58] Field of Search ..... 123/674, 675, 123/698, 520

[56] References Cited

U.S. PATENT DOCUMENTS

| | | | |
|---|---|---|---|
| 4,683,861 | 8/1987 | Breitkreuz et al. | 123/520 |
| 4,865,000 | 9/1989 | Yajima | 123/520 |
| 5,048,493 | 9/1991 | Orzel et al. | 123/674 |
| 5,090,388 | 2/1992 | Hamburg et al. | 123/674 |
| 5,203,870 | 4/1993 | Kayanuma et al. | 123/520 |
| 5,216,991 | 6/1993 | Iida et al. | 123/520 |
| 5,245,978 | 9/1993 | Orzel | 123/698 |
| 5,363,830 | 11/1994 | Morikawa | 123/674 |

FOREIGN PATENT DOCUMENTS

| | | |
|---|---|---|
| 352367 | 5/1991 | Japan . |
| 3286173 | 12/1991 | Japan . |
| 5215020 | 8/1993 | Japan . |
| 5288107 | 11/1993 | Japan . |

*Primary Examiner*—Willis R. Wolfe
*Attorney, Agent, or Firm*—Cushman, Darby & Cushman

[57] ABSTRACT

An air/fuel control system for an internal combustion engine or the like delivers evaporated gas from the engine's fuel tank and adsorbed in a canister to an intake of the engine via a discharge route. A purge vacuum switching valve (VSV 16) disposed in the discharge route controls the rate at which the evaporated gas is delivered to the engine intake. Using a sensor, the air/fuel ratio of the engine intake is determined and the deviation of the detected air/fuel ratio from a target ratio calculated according to learned air/fuel ratio parameters is calculated. The density of the evaporated fuel stream is determined based on that deviation, and the VSV is driven based on the calculated evaporated gas density. If the air/fuel parameters are not learned within a predetermined time, the VSV is driven at a fixed rate. A drive signal to the engine's fuel injection system also may be corrected based on the calculated evaporated fuel density.

22 Claims, 20 Drawing Sheets

FULL-OPEN PURGE RATE RPRG (%)

| NE (rpm) \ PM (mmHg) | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

PURGE VALVE CORRECTION

XPRG=1?
601
NO
YES
XF1=1?
602
YES
NO
TIMER START
603
READ Tp OR PM
604
CALCULATE NE
605
CALCULATE AIR QUANTITY GA
606
CALCULATE GPRG = GA X RPRG
607
CALCULATE VSV DUTY RATIO
608
RENEW PEAK VALUE OF FLPRGP
609
240 SEC. AFTER E/G START?
610
XF1 ← 1
611
612
FLPRGP<5%?
YES
NO
613
VSV OUTPUT + C
614
FLPRGP<15%?
YES
NO
616
615
VSV OUTPUT − C
VSV OUTPUT
CHECK VSV OUTPUT UPPER AND LOWER LIMITS
617
RESET TIMER
618
RETURN

FIG. 12

DUTY RATIO MAP (%)

| GPRG (g/sec) \ GAUGE (mmHg) | 40 | 79 | 118 | 157 | 196 | 235 | 274 | 313 | 352 | • |
|---|---|---|---|---|---|---|---|---|---|---|
| 0.0 | 5.0 | 5.0 | 5.0 | 5.0 | 5.0 | 5.0 | 5.0 | 5.0 | • | • |
| 0.1 | 50.0 | 30.0 | 26.0 | 23.0 | 20.0 | 19.0 | 17.5 | 16.0 | • | • |
| 0.2 | 90.0 | 60.0 | 50.0 | 45.0 | 40.0 | 38.0 | 35.0 | • | • | • |
| 0.3 | 99.7 | 99.7 | 75.0 | 67.0 | 60.0 | 58.0 | 53.0 | • | • | • |
| 0.4 | 99.7 | 99.7 | 99.7 | 88.0 | 80.0 | 73.0 | • | • | • | • |
| 0.5 | 99.7 | 99.7 | 99.7 | 98.0 | 91.0 | 88.0 | • | • | • | • |
| 0.6 | 99.7 | 99.7 | 99.7 | 99.7 | 99.7 | • | • | • | • | • |
| 0.7 | 99.7 | 99.7 | 99.7 | 99.7 | 99.7 | • | • | • | • | • |
| 0.8 | 99.7 | 99.7 | 99.7 | 99.7 | 99.7 | • | • | • | • | • |

FIG. 13

DUTY RATIO MAP (%)

| NE(rpm) \ PM (mmHg) | 280 | 358 | 436 | 515 | 593 | 671 | 749 | 827 |
|---|---|---|---|---|---|---|---|---|
| 1200 | 0.0 | 0.0 | 0.0 | 0.0 | 0.0 | 99.6 | 99.6 | 99.6 |
| 1600 | 0.0 | 0.0 | 0.0 | 0.0 | 0.0 | 99.6 | 99.6 | 99.6 |
| 2000 | 0.0 | 0.0 | 0.0 | 0.0 | 0.0 | 99.6 | 99.6 | 99.6 |
| 2400 | 0.0 | 0.0 | 0.0 | 0.0 | 0.0 | 99.6 | 99.6 | 99.6 |
| 2800 | 0.0 | 0.0 | 0.0 | 0.0 | 0.0 | 99.6 | 99.6 | 99.6 |
| 3200 | 0.0 | 0.0 | 0.0 | 0.0 | 0.0 | 99.6 | 99.6 | 99.6 |
| 3600 | 0.0 | 0.0 | 0.0 | 0.0 | 0.0 | 99.6 | 99.6 | 99.6 |
| 4000 | 0.0 | 0.0 | 0.0 | 0.0 | 0.0 | 99.6 | 99.6 | 99.6 |
| 4400 | 99.6 | 99.6 | 99.6 | 99.6 | 99.6 | 99.6 | 99.6 | 99.6 |
| 4800 | 99.6 | 99.6 | 99.6 | 99.6 | 99.6 | 99.6 | 99.6 | 99.6 |
| 5200 | 99.6 | 99.6 | 99.6 | 99.6 | 99.6 | 99.6 | 99.6 | 99.6 |
| 5600 | 99.6 | 99.6 | 99.6 | 99.6 | 99.6 | 99.6 | 99.6 | 99.6 |
| 6000 | 99.6 | 99.6 | 99.6 | 99.6 | 99.6 | 99.6 | 99.6 | 99.6 |
| 6400 | 99.6 | 99.6 | 99.6 | 99.6 | 99.6 | 99.6 | 99.6 | 99.6 |
| 6800 | 99.6 | 99.6 | 99.6 | 99.6 | 99.6 | 99.6 | 99.6 | 99.6 |

AIR-FUEL RATIO SYSTEM FOR AN INTERNAL COMBUSTION ENGINE

CROSS-REFERENCE TO RELATED APPLICATIONS

This application is based on and claims priority from Japanese Patent Applications Nos. 6-22405, 6-49036 and 6-49037, the contents of which are hereby incorporated by reference.

BACKGROUND OF THE INVENTION

1. Field of the Invention

This invention concerns an air/fuel ratio control system for purging the evaporated fuel generated in the fuel tank of an internal combustion engine and discharging the evaporated fuel to the intake side of the engine.

2. Description of the Related Art

Japanese Patent Application Kokai No. 5-187332 discloses a system for an internal combustion engine which learns the drive start signal of the engine's flow volume control valve or purge control valve during idle to carry out linear correction of the flow volume characteristics of the flow volume control valve, thereby preventing deterioration of exhaust emission quality. Japanese Patent Application Kokai No. 5-215020 discloses sequential detection of the flow volume in the flow volume control valve with a flowmeter to correct the drive signal and accurately control the purge volume of the flow volume control valve.

In both of these cases, when the engine is not idling, if the difference of the former and latter pressure of the flow volume control valve should change, the duty ratio flow volume characteristics of that flow volume control valve change, so that it is impossible to completely prevent a worsening of exhaust emission quality with simple linear correction procedures. Also, the nominal error of the flow volume control valve, i.e., differences in relation to the design logic values which arise from differences in the unique part production dimensions of individual flow volume control valves occurs even with a high duty ratio (about 90%) so that it is not possible to make entirely accurate corrections. Furthermore, the latter also requires a flowmeter, making the structure more complex.

In addition, regarding such an air-fuel ratio control device, if phenomena occur in the process of learning and implementing control of the valve, such as that the learning values extend to the upper and lower values of the learning routine or that the air/fuel ratio sensor output becomes unstable, stabilization of the air/fuel ratio is delayed and it is impossible to carry out the evaporation purge process until the air/fuel ratio stabilizes. If the evaporation purge process is stopped in this way for an excessively long period, the evaporation purge adsorption volume of the canister will attain a saturated state, thereby making any further adsorption impossible.

Moreover, with such an air/fuel ratio control device the fuel injection amount of the injector is corrected in relation to the recommended density value of the evaporated gas (hereafter referred to as the evaporated gas density). As a result, in order to realize accurate air/fuel ratio control in relation to the evaporation purge-process, it is important to accurately assess the evaporated gas density. A variety of methods have already been proposed for assessing the evaporated gas density. See, for example, Japanese Patent Application Kokai No. 5-288107.

However, there is a further problem with conventional air/fuel ratio control devices. Carrying out air/fuel ratio control with the estimated evaporated gas density produces a rough value so that if the evaporated gas density suddenly changes, it takes time for the evaporated gas density, i.e., the estimated value, to agree with the actual density. In particular, because the evaporated gas density increases during engine start and fueling, this factor can easily lead to discrepancies in the air/fuel ratio.

SUMMARY OF THE INVENTION

This invention was created to solve these problems. The primary purpose of the invention is to provide an internal combustion engine air/fuel ratio control system that makes it possible to eliminate, without making the structure significantly more complex, the effects of characteristic changes of the individual sections that arise during construction and the effects of assembly and change over time of the flow control valve which discharges the evaporated fuel generated in the fuel tank together with air to the intake side of the internal combustion engine.

A second purpose of the invention is to provide an air/fuel ratio control system for an internal combustion engine that makes it possible to reliably discharge evaporated gas even in the event of extension of the air/fuel ratio learning time and other similar events.

A third purpose of this invention is to provide an air/fuel ratio control system for an internal combustion engine that makes it possible to quickly and accurately assess the density of the evaporated gas at all times and thus realize accurate air/fuel ratio control.

In the first aspect of the invention, when employing the air/fuel ratio control system of this invention, there is feedback of the air/fuel ratio of the mixed gas supplied to the internal combustion engine based on the air/fuel ratio derived with an air/fuel ratio detection sensor. Then a deviation detection section is employed to derive the deviation of a theoretical air/fuel ratio with the air/fuel feedback value obtained from the air/fuel feedback sensor when changing the air volume with the flow control valve. Based on that deviation, the density of the evaporated gas is calculated in a density calculation stage. Based on the evaporated fuel density derived in this way and a drive signal of the flow control valve corresponding to this evaporated fuel density, the drive signal of the flow control valve is offset with the offset setting section. In this way, based on the density of the evaporated fuel obtained from the deviation value corresponding to the theoretical air/fuel ratio and the air/fuel ratio feedback sensor value and a drive signal of the flow control valve corresponding to this evaporated fuel density, the drive signal of the flow control valve is offset. Stated in another way, during feedback control of the air/fuel ratio, the drive signal of the flow control valve is offset so that the density of the evaporated fuel is within a permissible range at all times.

In the second aspect of the invention described above, the evaporated fuel generated in the fuel tank is adsorbed in the canister. This evaporated fuel travels along the discharge path following the opening and closing motion of the switching valve before being discharged into the intake system of the internal combustion engine. The air/fuel sensor detects the air/fuel ratio of the mixed gas supplied to the internal combustion engine. The air/fuel ratio learning method includes a method to correct the air/fuel ratio discrepancy amount between the air/fuel ratio detected by the air/fuel ratio sensor and the target air/fuel ratio.

As a method of determining when the air/fuel ratio learning process is complete, during implementation of learning by the air/fuel ratio learning method there is a determination of learning completion conditions based on the deviation of the air/fuel ratio from the target air/fuel ratio. Along with establishment of learning completion conditions according to the method for determining learning completion conditions, there is opening-closing motion of the switching valve. Also, if the learning completion conditions as determined by the method for learning completion condition described above are not achieved during a set period, there is a temporary termination of learning with the air/fuel ratio learning method, and forced opening and closing of the switching valve is implemented. As an air/fuel ratio control method, there is control of the fuel injection volume by the injector based on the learning values of the air/fuel ratio learning method so that the air/fuel ratio detected by the sensor reaches the target air/fuel ratio.

Stated in another way, when using an air/fuel ratio control system in which there is discharge of evaporated gas by the switching valve along with establishment of learning completion conditions, if the learning values extend to the upper and lower values due to unstable variations in the air/fuel ratio during the learning process, it is not possible to carry out purging of evaporated fuel until that variation ceases. However, with the present structure, purging of evaporated fuel can definitely be carried out even in case of the anomalies described above.

In the third aspect of the invention described above, the evaporated fuel generated in the fuel tank is adsorbed in the canister. As a valve control method, there is opening of the switching valve according to a defined timing, so that the evaporated fuel adsorbed in the canister travels along the discharge route before being discharged into the intake system of the internal combustion engine. As an injection volume computation method, there is calculation of the fuel injection volume by the injector in accordance with the running state of the internal combustion engine. In addition, as a method of estimating the evaporated fuel density, if the air/fuel ratio detected by the air/fuel ratio sensor during the opening period of the switching valve tends to be rich, the estimated density value of the evaporated fuel is increased to the extent of a defined renewal width. If the air/fuel ratio tends to be lean, the estimated density value of the evaporated fuel is decreased to the extent of the defined renewal width. As a method of setting the renewal width, there is setting of the renewal width of the density estimation section in accordance with the degree of deviation of the estimated density value obtained with the density estimation method from the actual density value. To correct the injection volume, the air/fuel ratio control system correction value based on the difference between the air/fuel ratio sensed by the air/fuel ratio sensor and the target air/fuel ratio may be used, as well as the estimated density value of the evaporated fuel as obtained by the density estimation method. Then correction of the fuel injection volume is performed by the injection volume calculation method in accordance with the above values. As the injector control method, there is driving of the injector based on the fuel injection volume following correction by the injection volume correction method.

Stated in another way, when correcting the fuel injection volume of the injector in accordance with the estimated density value of the evaporated fuel, if the estimated density value of the evaporated fuel and the actual density value do not agree, the correction of fuel injection is insufficient, thus leading to discrepancies in the air/fuel ratio (tending to be either rich or lean). However, with the structure described above, increasing or decreasing the estimated density value in accordance with the richness or leanness of the air/fuel ratio makes it possible to obtain appropriate density estimates and accurate air/fuel ratio control.

Also, with the structure described above, because the renewal width is set according to the extent of the deviation between the estimated density value from the actual density value of the evaporated fuel, in cases where the actual density value changes suddenly during engine start or fueling, for example, the estimated density value obtained with the density estimation method quickly attains the actual density value. As a result, even temporary disturbances in the air/fuel ratio resulting from sudden changes in the evaporated fuel can be quickly resolved.

BRIEF DESCRIPTION OF THE DRAWINGS

FIG. 12 is a table used to obtain the duty value;

FIG. 13 is a table used to obtain the duty ratio;

DETAILED DESCRIPTION OF THE PRESENTLY PREFERRED EXEMPLARY EMBODIMENTS

Hereinafter a first embodiment of the present invention will be described.

Figure 1:
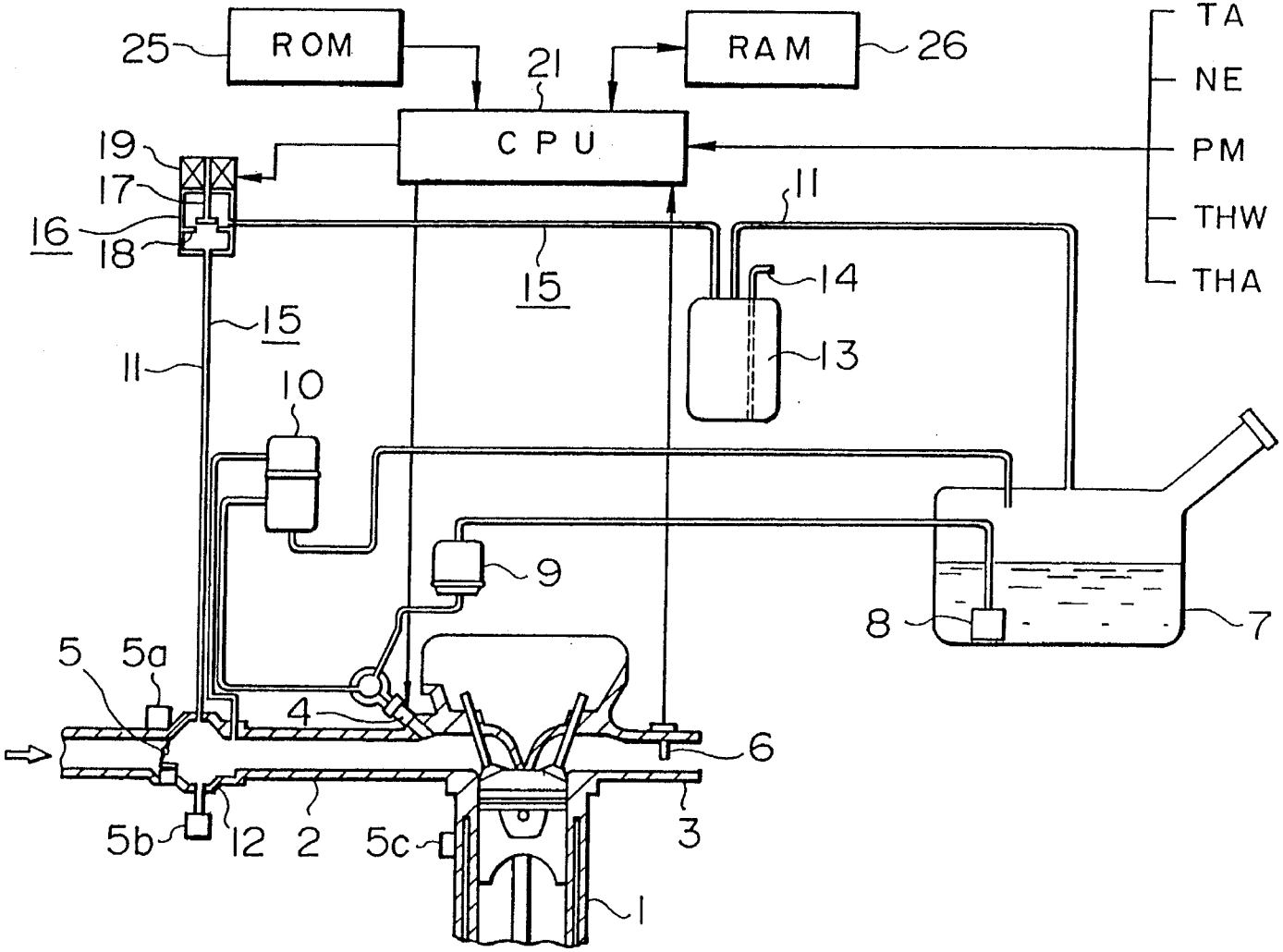
FIG. 1 is a diagram showing an air/fuel ratio control system of the internal combustion engine according to the present invention.

FIG. 1 is a diagram showing the air/fuel ratio control system of the internal combustion engine involved in a first embodiment of this invention.

In FIG. 1, reference numeral 1 denotes an internal combustion engine having multiple cylinders. Connected to this engine 1 are an intake pipe 2 and an exhaust pipe 3. On the engine side of the intake pipe 2 are located fuel injector 4 and a throttle valve 5 upstream of the intake pipe 2. In addition, located in the exhaust pipe 3 is an oxygen ($O_2$) sensor 6 functioning as the air/fuel ratio detector. The oxygen sensor 6 outputs a voltage signal in accordance with the oxygen concentration in the exhaust gas.

The fuel supply system to supply fuel to the injector 4 is composed of a fuel tank 7, fuel pump 8, fuel filter 9 and pressure adjustment valve 10. The fuel (gasoline) in fuel tank 7 is forced to the injector 4 via the fuel filter 9 and the fuel pump 8, and the fuel supplied to the injector 4 by the pressure adjustment valve 10 is adjusted to the determined pressure.

Figures 2, 3:
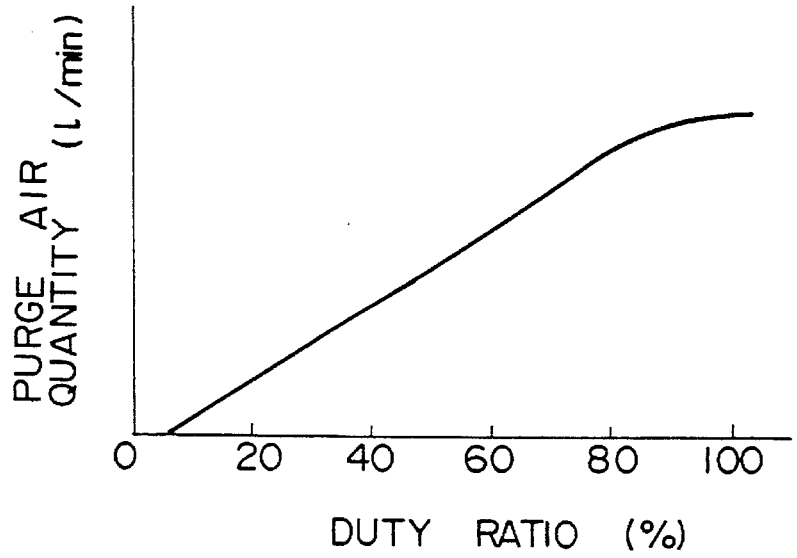
FIG. 2 is a characteristic curve showing the purge air volume Qp in relation to the purge control valve duty ratio used by the air/fuel ratio control system of the internal combustion engine according to a first embodiment of this invention.
FIG. 3 is a table of the full-opening purge rate which uses the engine rotational speed NE and intake pressure PM used by the air/fuel ratio control system of the internal combustion engine involved in the embodiment.

A purge pipe 11 extending from the top of the fuel tank 7 communicates with a surge tank 12 of the intake pipe 2. Located midway in the purge pipe 11 is a canister 13 housing therein activated charcoal used as an adsorbent in adsorbing evaporated fuel generated in the fuel tank 7. Also located in the canister 13 is an air release hole 14. The purge pipe 11 uses the surge tank side of the canister 13 as a discharge route 15. Located midway on this discharge route 15 is a purge vacuum switching valve (hereafter known simply as VSV) 16 comprising a flow control valve. This VSV 16 is provided so that the valve body 17 is positioned to normally close the seat section 18 by a spring (not shown in drawing). The valve body 17 opens the seat section 18 through excitation of a coil 19. As a result, the discharge route 15 closes due to deenergization of the coil 19 of purge VSV 16, and discharge route 15 opens due to energization or excitation of coil 19. Using duty ratio control based on pulse width modulation, this purge VSV 16 undergoes opening adjustment by the CPU 21 to be described below. As a result, control signals are emitted from the CPU 21 to the purge VSV 16 so that if the canister 13 has access to the intake pipe 2 of the engine 1, there is introduction of new air Qa from the atmosphere via the air release hole 14. This air ventilates the inside of the canister 13 and is sent from intake pipe 2 to the inside of the cylinders of the engine 1 to carry out canister purge. By this process, it is possible to implement the adsorption function of the canister 13. Also, the purge air quantity or volume Qp (l/min) of the new air guided in via the purge VSV 16 is adjusted by changing the duty ratio (%) of the pulse signal emitted from a CPU 21 to the purge VSV 16. FIG. 2 is a characteristic curve showing the purge air volume Qp (l/min) in relation to the duty ratio (%) at this time. It shows the relationship between the duty ratio (%) and the purge air volume Qp of the purge VSV 16 when the negative pressure in the intake pipe is steady. It can be understood from this graph that as the purge VSV 16 increases the duty ratio from 0%, the purge air volume (i.e., the air volume taken in to the engine 1 via the canister 13), is increased roughly linearly.

The CPU 21 inputs the following signals: (1) the throttle opening signal TA from the throttle sensor 5*a* detecting the opening degree of the throttle valve 5; (2) the engine rotational speed NE signal from the rotation velocity sensor (not shown in FIG. 1) detecting the engine rotational speed of the engine 1; (3) the intake pressure signal PM from the intake pressure sensor 5*b* (also known as the intake air volume signal from the intake air volume sensor) detecting the intake air pressure passing over throttle valve 5; (4) the cooling water temperature signal THW from the water temperature sensor 5*c* detecting the cooling water temperature of the engine 1; and (5) the intake temperature signal THA from the intake air temperature sensor (not shown in figure) detecting the intake air temperature.

In addition, the CPU 21 inputs the output signal (voltage signal) from the oxygen sensor 6 to carry out rich/lean measurement of the exhaust gas. Also, the CPU 21 carries out large skips (proportional control) in steplike fashion of the air/fuel ratio feedback coefficient to be described later in order to increase or decrease the fuel injection volume when there is a turnover from rich to lean or from lean to rich. It also gradually increases or decreases the air/fuel ratio value FAF (integral control) when a rich or lean state continues. This feedback control is not carried out if the cooling water temperature is low, or during high engine loads or when the engine is running at a high rotational speed. Also, the CPU 21 derives the basic injection time based on the engine rotational speed and intake pressure to carry out correction of the FAF value (air/fuel ratio feedback coefficient), etc. in relation to the basic injection time and thus obtain the final injection time and carry out fuel injection in injector 4 according to the required injection time.

A ROM 25 stores the control programs and tables for controlling the overall operations of the engine 1. A RAM 26 temporarily stores various data such as detection data of the throttle opening of the throttle valve 5 and the engine rotational speed. The CPU 21 controls the operation of the engine 1 based on the control program in ROM 25.

FIG. 3 is a table showing the full-open purge rate RPRG (%). This is determined by the engine rotational speed NE (rpm) and the intake pressure PM (mmHg). (The load in this embodiment is intake pressure, although loads using intake air volume or throttle opening are also possible). This table shows the air volume that flows via the discharge route 15 when the duty valve of purge VSV 16 is 100% open in relation to the total air flowing to the engine 1 via the intake pipe 2. This table is stored in the ROM 25.

With the air/fuel ratio control system of the engine in this embodiment, the following control functions are carried out: control of air/fuel ratio F/B (feedback), control of air/fuel ratio (A/F) learning, control of purge rate, control of evaporative emission density learning, control of fuel injection volume, and control of purge VSV.

The following is a description of the individual controls for the operations of the embodiment.

1. Control of Air/Fuel Ratio F/B (Feedback)

Figure 4:
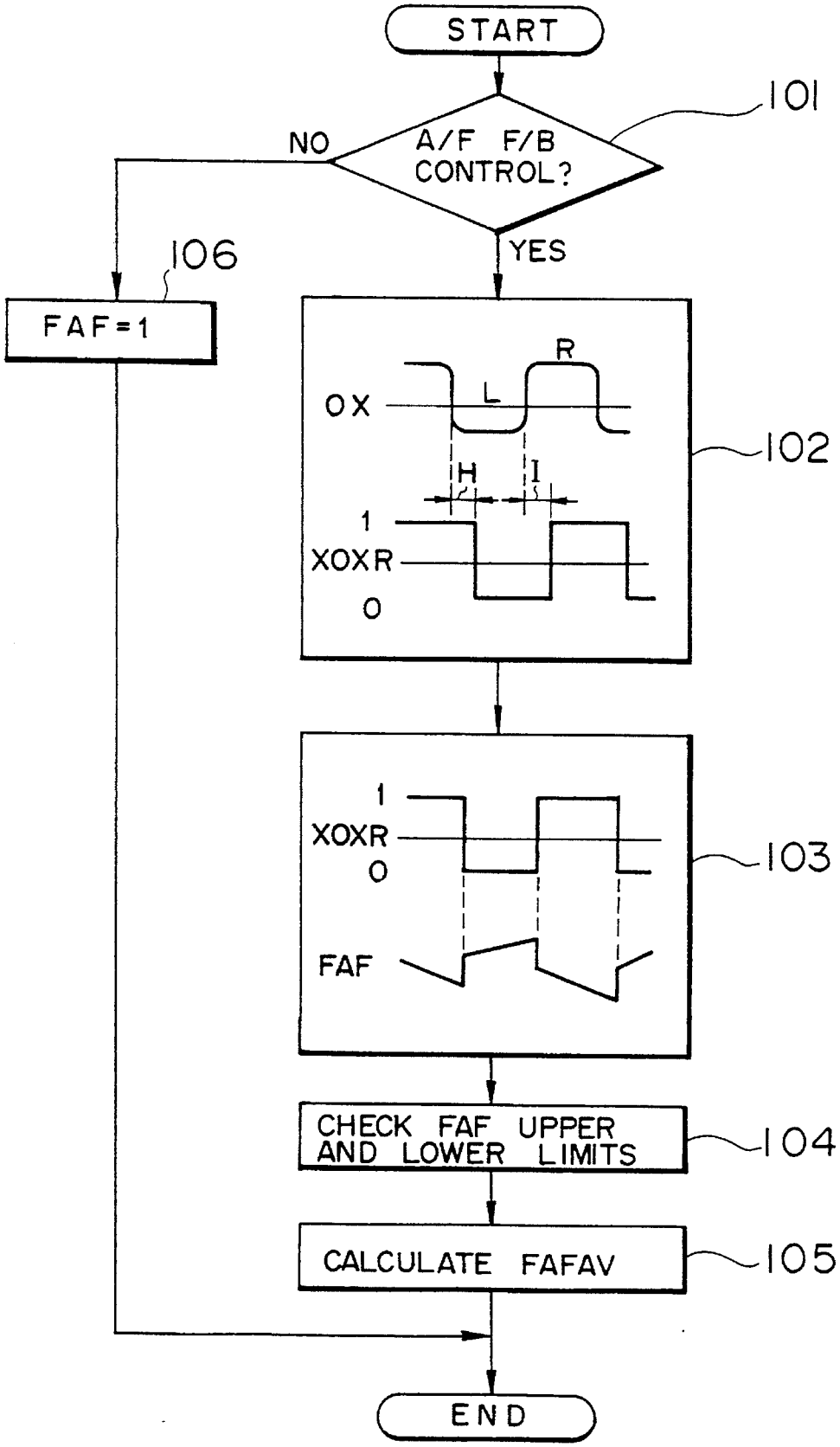
FIG. 4 is a flow chart showing the order for processing air/fuel ratio feedback control of the air/fuel ratio control system of the internal combustion engine in the embodiment.

The air/fuel ratio F/B control route is described based on FIG. 4. This air/fuel ratio F/B control routine is executed by the CPU 21 at every 4 ms.

Step 101 determines whether air/fuel ratio F/B control is possible. Control is possible when all the following conditions have been satisfied as air/fuel ratio F/B conditions: (1) it is not starting time; (2) the fuel is not cut off; (3) the cooling water temperature (THW) is above the required temperature; (4) the fuel injection volume (TAU) is above the minimum value (TAUmin); and (5) the oxygen sensor is in an activated state.

If all these conditions are present, the process proceeds to step 102 where there is comparison of the oxygen sensor target output and the reference level OX corresponding to the target stoichiometric air/fuel ratio to operate the air/fuel ratio flag XOXR based on the delay time H, I (ms). For example, if XOXR=1 the value is rich (R) and if XOXR=0 the value is lean (L). The process proceeds to step 103 where there is operation of the FAF value or air/fuel ratio feedback coefficient based on the air/fuel ratio flag XOXR. Stated in another way, if XOXR changes from 0 to 1 or from 1 to 0, there is skipping (proportional control) of the FAF value by the required amount (ratio control). Conversely, if XOXR continues at 1 or 0, there is execution of integral control of the FAF value. In step 104, there is checking of the upper and lower limits of the FAF value before proceeding to step 105 to carry out smoothing for each skip or at regular intervals based on the determined FAF value and thus obtain the FAFAV value which is the average value of the FAF value. In addition, if air/fuel ratio F/B control is not possible in step 101, the process proceeds to step 106 where the initial value of the FAF value is set at 1.0 which indicates no correction. This is an index showing the extent to which the FAF value which is the air/fuel ratio feedback coefficient deviates from the theoretical air/fuel ratio. Stated in another way, this is the extent to which the air/fuel ratio (e.g., fuel volume) should be corrected.

2. Control of Air/Fuel Ratio (A/F) Learning

Figure 5:
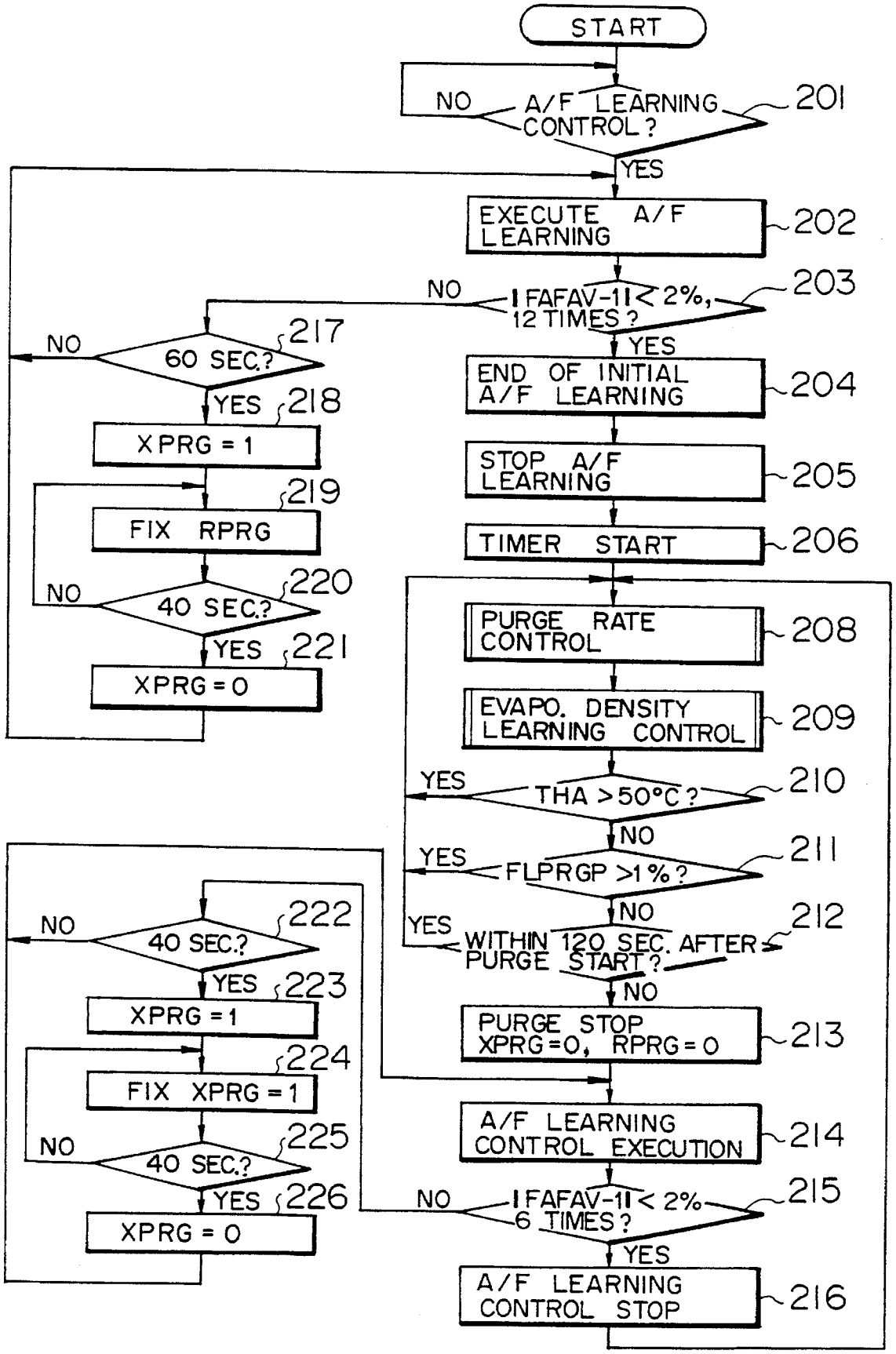
FIG. 5 is a flow chart showing the order of processing of air/fuel ratio learning control of the air/fuel ratio control system of the internal combustion engine in the embodiment.

The A/F learning control routine is described based on FIG. 5. Moreover, the A/F learning control routine is for achieving a deviation detection section and is executed by the CPU 21 at every 32 ms.

First, in step 201 the system waits until the conditions prior to A/F learning such as A/F conditions and cooling water temperature conditions are present before proceeding to step 202. In step 202 there is the start of A/F learning before proceeding to step 203 to determine whether the deviation |FAFAV-1| in relation to the basic value 1 of the FAFAV value (the average value of the FAF value) has exceeded 2%. A/F learning is within this range and is carried out 12 times in succession before proceeding to step 204. In step 204 there is the conclusion of ending initial A/F learning before proceeding to step 205 where A/F learning is stopped. The process proceeds to step 206 where the timer is started. In step 208 there is control of the purge rate as described below and in step 209 there is control of the evaporated gas density learning as described below. In the following steps 210 to 212 there is checking of the purge execution conditions. Step 210 determines whether the air temperature (e.g., the intake temperature THA) exceeds 50° C. If not, the process goes to step 211 to determine whether the evaporated gas density value FLPRG exceeds 1%. If not, steps 207 to 211 are repeated, giving preference to purge over A/F learning. If FLPRG is not greater than 1% in step 211, the process goes to step 212 to determine whether it is within 120 seconds after the start of purge. Stated in another way, if the intake temperature THA and the evaporated gas density value FLPRG are both low so that the interior of the canister 13 is almost empty, if the 120 seconds after start of purge (set beforehand) are exceeded, the process goes to step 213 and purge is stopped (XPRG=0, RPRG=0). The process then goes to step 214 to start execution of A/F learning before proceeding to step 215. Here, similar to the process in step 203, the system determines whether the deviation |FAFAV−1| in relation to the basic value 1 of the FAFAV value (the average value of the FAF value) has exceeded 2%. A/F learning is within this range and is carried out 6 times in succession before proceeding to step 216. In step 216 the process stops upon completion of A/F learning, after which the process returns to step 207 and the same process is repeated.

During the initial learning time, the CPU 21 determines in step 217 whether the elapsed time after start of initial learning is within the required time (60 seconds in this embodiment). Stated in another way, the learning correction value FLRN generally has an upper and lower limit, and if the learning correction value FLRN reaches the upper or lower limit, because the air/fuel ratio is not around the target value, step 217 reaches an affirmative determination. If so, the CPU 21 proceeds to step 218 and executes fixed control of the purge rate RPRG in steps 218 to 220.

To state this in more detail, in step 218 the CPU 21 sets the purge execution flag XPRG at [1] and in step 219 it fixes the purge rate RPRG at the required value (e.g., RPRG=1%). At this time, there is evaporation purge to obtain the minimum purge based on fixed control of the purge rate RPRG. If step 220 is fulfilled (e.g., if step 219 is continued for 40 seconds), the CPU 21 resets the purge execution flag XPRG to [0] in step 221 and then returns to step 202. Following this, the CPU 21 re-executes steps 212, 203 and 217 and then proceeds to step 204 when the continued reaching of the learning correction value FLRN to the limit is resolved and step 203 is satisfied.

In addition, during regular learning, in step 222 the CPU 21 determines whether the elapsed time after start of regular learning is within the determined time (40 seconds in this embodiment). If there is an affirmative determination in step 222, the CPU 21 executes fixed control of the purge rate RPRG in steps 223 to 226. Stated in another way, in step 223 the CPU 21 sets the purge execution flag XPRG to [1] and in step 224 it fixes the purge rate RPRG to the required value (e.g., RPRG=1%). If it is determined in step 225 that 40 seconds have elapsed, the CPU 21 resets the purge execution flag XPRG to [0] in step 126 and then returns to step 214. Following this, the CPU 21 re-executes steps 214, 215 and 222 and then returns to step 216 when step 215 has been satisfied.

Figure 6:
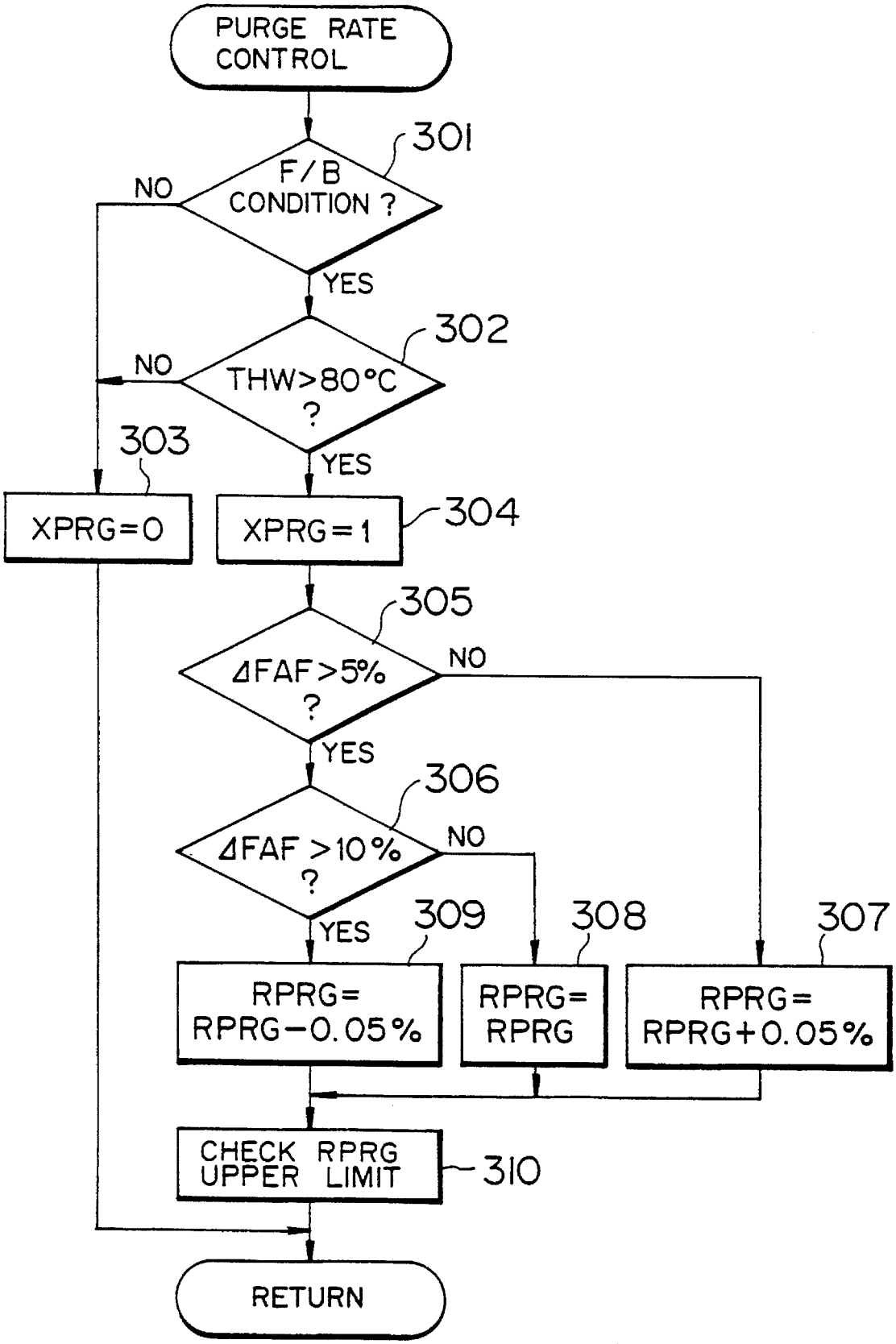
FIG. 6 is a flow chart showing the execution of the purge rate calculation routine.

There now follows a description of the details of purge control 208 as shown in FIG. 5. As shown in FIG. 6, in step 301 the CPU 21 determines whether the feedback conditions described above are present and then in step 302 it determines whether the cooling water temperature THW is greater than 80° C. If there is a negative determination for either step 301 or step 302, the CPU 21 proceeds to step 303 and resets the purge execution flag XPRG to [0] to conclude this routine.

If there is an affirmative determination for steps 301 and 302, in step 304 the CPU 21 sets the purge execution flag XPRG to [1] and calculates the purge rate RPRG in steps 305 to 309. To state this in more detail, in step 306 the CPU 21 determines whether the deviation ΔFAF is greater than 5%. In step 306 it determines whether the deviation ΔFAF is greater than 10%. If ΔFAF is less than or equal to 5% the CPU 21 proceeds to step 307 and increases the value of the purge rate RPRG by 0.05%. If ΔFAF is greater than 5% and less than or equal to 10%, the CPU 21 proceeds to step 308 and holds the purge rate RPRG as before to the value at that time. If ΔFAF is greater than 10%, the CPU 21 proceeds to step 309 and decreases the purge rate RPRG value by 0.05%.

Finally, in step 310 the CPU 21 checks whether the purge rate RPRG is within the upper limit set according to the table of FIG. 3. If the value exceeds the upper limit it is held at the upper limit value. FIG. 3 is a full-open purge rate table determined by the engine rotational speed NE and the engine load. (Although the intake pressure PM is used as the engine load in this embodiment, use of the intake air volume or throttle opening is also acceptable). This shows the maximum purge rate when the duty ratio of the purge valve 16 is 100%.

Figure 7:
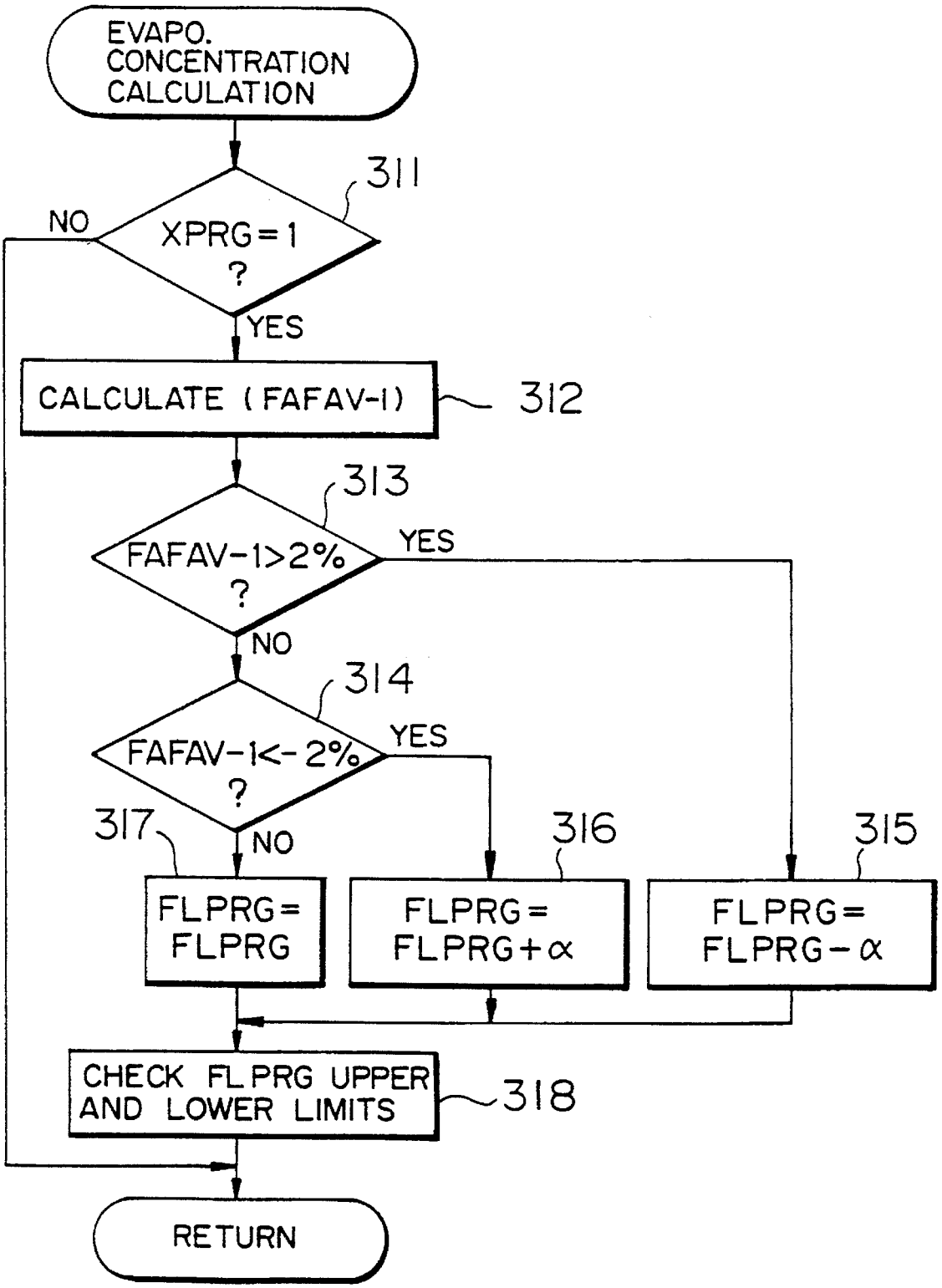
FIG. 7 is a flow chart showing the evaporated density calculation routine.

In the evaporated gas concentration or density calculation routine shown in FIG. 7, the CPU 21 determines in step 311 whether the purge execution flag XPRG=[1]. If XPRG=[0], the CPU 21 ends the routine there. If XPRG=[1], the CPU 21 obtains in step 312 the value (FAFAV−1) by subtracting from the feedback correction coefficient FAF the standard value, i.e., 1, from the smoothed value FAFAV of the feedback correction coefficient FAF. Following this, CPU 21 determines the evaporated gas density FLPRG in steps 313 to 317 (estimation of evaporated gas density FLPRG).

Stated in another way, in step 313 the CPU 21 determines whether (FAFAV−1) is greater than 2%. In step 314 it determines whether (FAFAV−1) is less than −2%. If (FAFAV−1) is greater than 2% (e.g., if the air/fuel ratio tends toward lean), the CPU 21 determines that the actual evaporated gas density FLPRG is leaner than the present evaporated gas density FLPRG. In step 305 CPU 21 reduces the evaporated gas density value FLPRG by the density renewal width α. If (FAFAV−1) is less than −2% (e.g., if the air/fuel ratio tends toward rich), the CPU 21 determines that the actual evaporated gas density FLPRG is richer than the present evaporated gas density FLPRG. In step 316 it increases the evaporated gas density FLPRG by the density renewal width α. If (FAFAV−1) is greater than or equal to −2% and less than or equal to 2%, the CPU 21 determines that the present evaporated gas density FLPRG is roughly the actual value and in step 317 it holds the evaporated gas density FLPRG at the value for that time.

After estimating the evaporated gas density FLPRG, the CPU 21 checks in step 318 whether the evaporated gas density FLPRG is within the upper and lower limit values of 0% through 25% to finish the routine.

Figure 8:
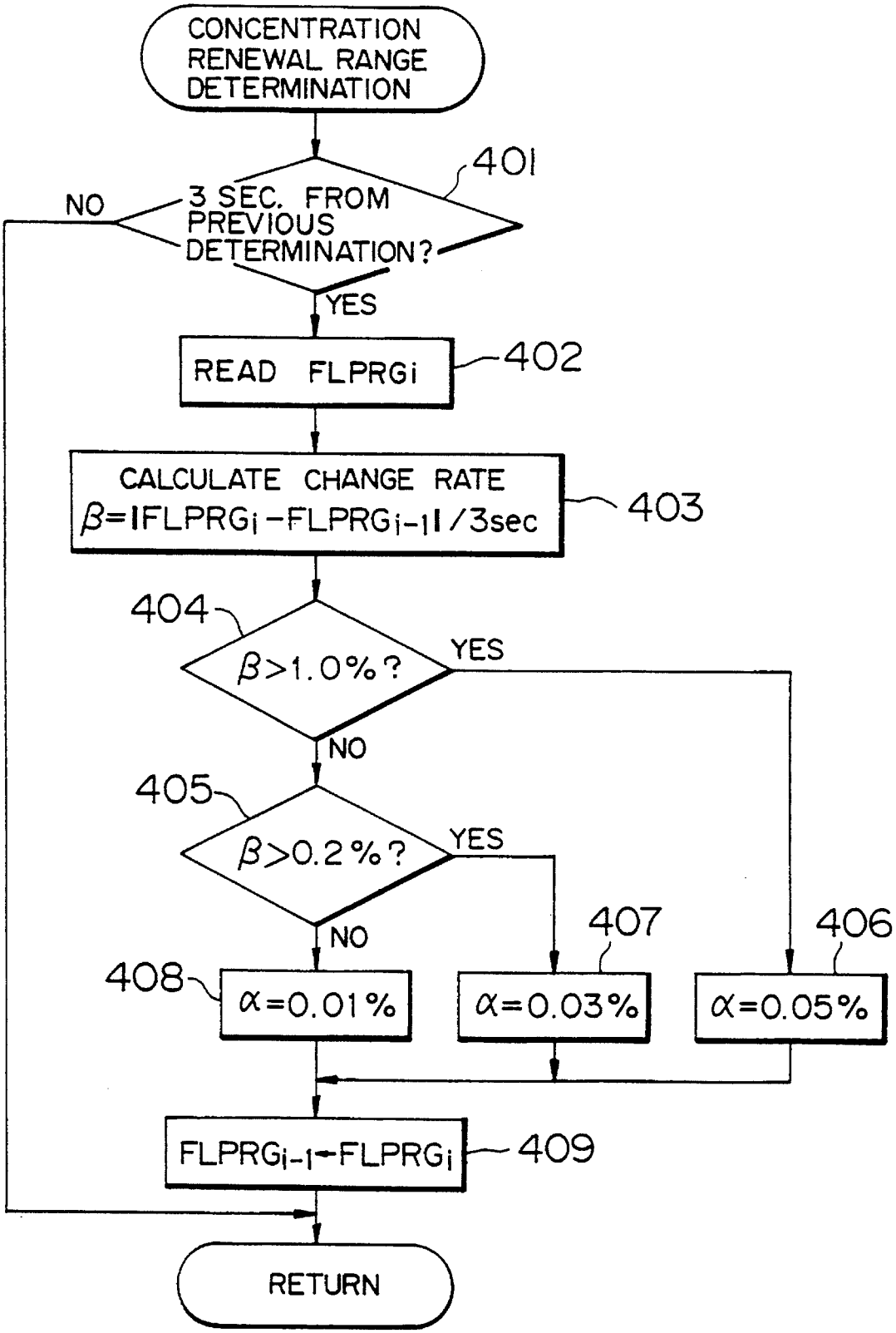
FIG. 8 is a flow chart showing the density renewal width setting routine.

Next follows a description of the density renewal setting routine as shown in FIG. 8. This routine is executed at periodic intervals of 4 msec by the CPU 21.

As is shown in FIG. 8, in an initial step 401 the CPU 21 determines whether the required time (3 seconds in this embodiment) has elapsed since determining the prior density renewal width α. If 3 seconds have elapsed, the CPU 21 proceeds to step 402 to obtain the evaporated gas density $FLPRG_i$ at that time (the additional "i" indicates that it is the value for the present time). In the following step 403 the CPU 21 calculates the amount of change (hereafter known as change amount B) of the evaporated gas density FLPRG per unit time from the evaporated gas density $FLPRG_{i-1}$ from this time and the evaporated gas density $FLPRG_{i-1}$ from the last time ($\beta = |FLPRG_i - FLPRG_{-i-1}|/3$ sec).

After this, the CPU 21 derives in steps 404 through 408 the density renewal width α (%) in relation to the value of the change amount β. To state this in more detail, in step 404 the CPU 21 determines whether β is greater than 1.0%. In step 405 it determines whether β is greater than 0.2%. If β is greater than 1.0% the CPU 21 proceeds to step 406 where α is set at 0.5%. If β is greater than 0.2% and less than or equal to 10% the CPU 21 proceeds to step 407 where α is set at 0.03%. If β is less than or equal to 0.2%, the CPU 21 proceeds to step 408 where α is set at 0.01%. Stated in another way, the greater the change rate β of the evaporated gas density FLPRG, the larger the value to which the density renewal width α is set. Furthermore, if the density renewal width α is too large, there is a danger of overshoot when converging on the density value. Thus, it is advisable to set the maximum value of the density renewal width α to a value where no overshoot occurs.

Following this, in step 409 the CPU 21 stores in the RAM 26 the present evaporated gas density $FLPRG_i$ as the previous evaporated gas density $FLPRG_{i-1}$ to end the routine.

Figure 9:
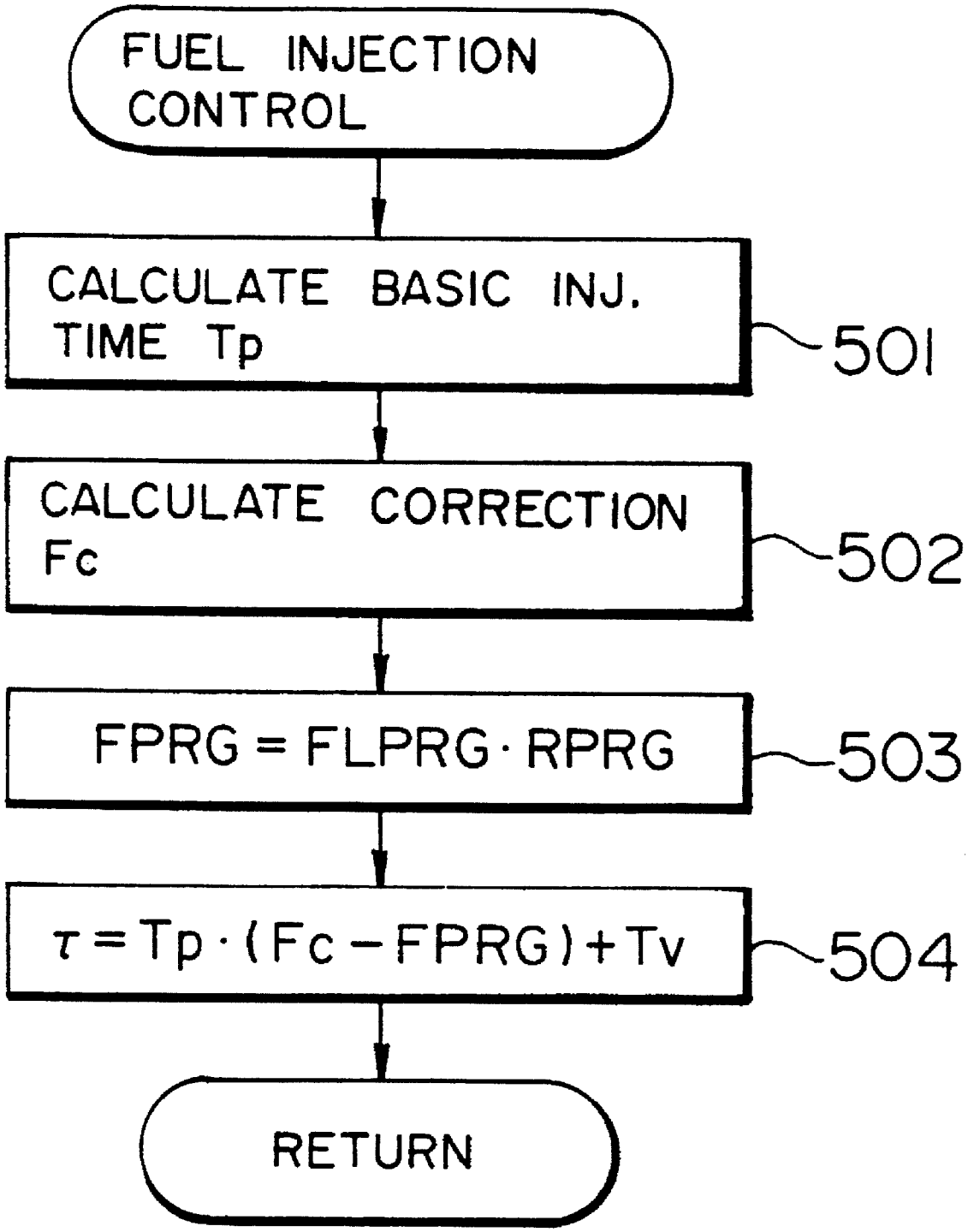
FIG. 9 is a flow chart showing the fuel injection control routine.

Next follows a description of the fuel injection control routine shown in FIG. 9. This routine is executed at time intervals of 4 msec by the CPU 21.

As is shown in FIG. 9, in step 501 the CPU 21 calculates a basic injection time Tp corresponding to the engine rotational speed NE and the intake pressure PM based on the data stored as a table in the ROM 25. Next, in step 502 the CPU 21 calculates the following: (1) the correction coefficients (cooling water temperature, fuel enrichment after start, intake air temperature, etc.) relating to the operation of the engine 1; (2) the feedback correction coefficient FAF; and (3) the basic correction coefficient Fc corresponding to the learning correction value FLRN. In the following step 503, the CPU 21 multiplies the evaporated gas density FLPRG obtained by the routine in FIG. 7 with the purge rate RPRG obtained by the routine in FIG. 6 and thus calculates the purge correction coefficient FPRG (FPRG=FLPRG× RPRG).

After this, in step 504 the CPU 21 calculates the final injection time τ based on the above-mentioned basic injection time Tp, the basic correction coefficient Fc, the purge correction coefficient FPRG and the noneffective injection time Tv (τ=Tp×(Fc−FPRG)+Tv). Then the CPU 21 carries out fuel injection by the injector 4 based on the final injection time τ at the required fuel injection timing.

Figure 10:
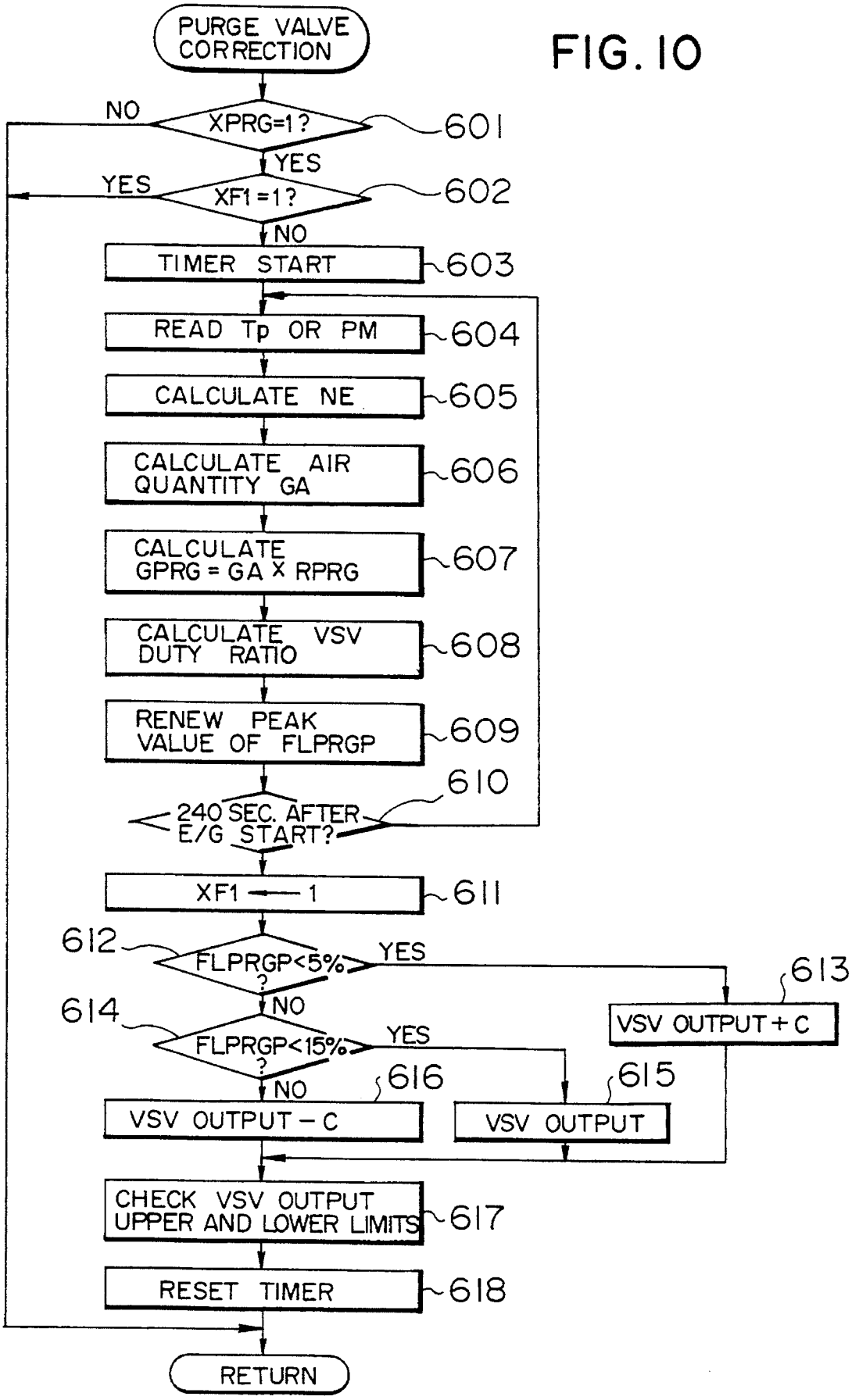
FIG. 10 is a flow chart showing the purge valve correction routine.

Next follows a description of the purge VSV correction routine shown in FIG. 10. This purge VSV correction routine, which is executed by the CPU 21 at a rate of once per trip, is carried out to achieve an offset setting section. With the ignition switch ON, there is initialization of the routine with XF1=0 and FLPRGP=0. XF1 indicates the tolerance correction flag and FLPRGP shows the evaporated gas density.

Figure 14:
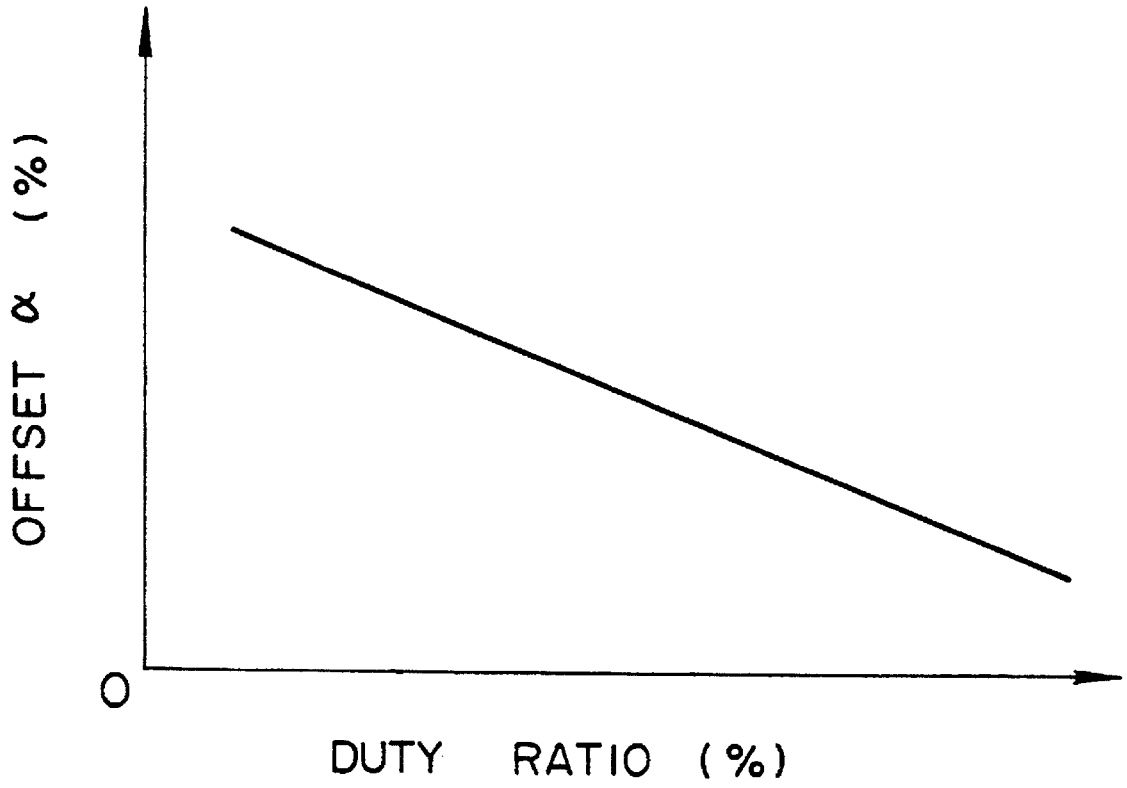
FIG. 14 is a characteristic curve showing the offset value in relation to the duty ratio obtained by addition or subtraction with the VSV output used in the air/fuel ratio control system of the internal combustion engine in the embodiment.

First, in step 601 it is determined whether the flag XPRG=1 before proceeding to step 602 where it is determined whether the tolerance correction execution flag XF1=1. If so, this routine is ended. Since XF1=0 and XF1≠1 in step 602 initially, the process goes to step 603 to start the internal timer before proceeding to step 604. In step 604, there is reading of the basic injection volume Tp as derived in step 501 of FIG. 9 or alternatively reading of the intake pressure PM. The process then goes to step 605 to calculate the engine rotational speed NE before going to step 606. The basic injection volume Tp (or the intake air pressure PM) as read in step 604 and the engine rotational speed NE calculated in step 605 are used to calculate the intake air quantity or volume GA. Next the process goes to step 607 where the purged flow volume GPRG is derived by multiplying the intake air volume GA calculated in step 606 by the purge rate RPRG as shown in FIG. 6. The process then goes to step 608 where the duty ratio is calculated by the table stored in the ROM 25. This is the duty ratio of the purge VSV 16 based on parameters with the differential air pressure (air pressure PA–intake pressure PM) (mmHg) and purged flow volume GPRG (l/min). The process then proceeds to step 609 which compares the peak value FLPRGP up to the previous time of the evaporated gas density FLPRG derived in FIG. 7 with the present detection value, after which the larger of the two becomes the new evaporated gas density peak value FLPRGP. The process then proceeds to step 610 which repeats steps 604 to 610 until 240 seconds elapse after the start of the engine 1. There is also repetition of renewal of the evaporated gas density peak value FLPRGP as in step 609. In step 610, when 240 seconds have elapsed since the start of the engine 1, the procedure goes to step 611 to set the tolerance correction execution flag XF1 to 1 and execution then proceeds to step 612. Here the routine determines whether the evaporated gas density peak value FLPRGP is less than 5%. If so, it is determined that the purge VSV 16 flow volume is low and the procedure goes to step 613. Here, based on the table stored in the ROM 25, the offset value c corresponding to the duty value at that time is added to the VSV output derived in FIG. 5. However, if FLGRP≧5% the process goes to step 614 where it determines whether the evaporated gas density peak value FLPRGP is less than 15%. If so, e.g., if the evaporated gas density peak value FLPRGP is between 5% and 15% it is determined that the flow volume of the purge VSV 16 is close to the tolerance mean value and the process goes to step 615 where the VSV output for that time is held as before. If FLGRP≧15%, it is determined that the flow volume of purge VSV 16 is too large and the process goes to step 616. Here, the offset value c in relation to the duty ratio (%) at that time based on the table shown in FIG. 14 is subtracted from the VSV output derived in FIG. 5. After processing in step 613, step 615 and step 616, the process goes to step 617 to check whether the VSV output is within 0% through 100% as a check of the output's upper and lower limits. After this the process proceeds to step 618 to reset the internal timer started in step 603 and thus end this routine.

Figure 11:
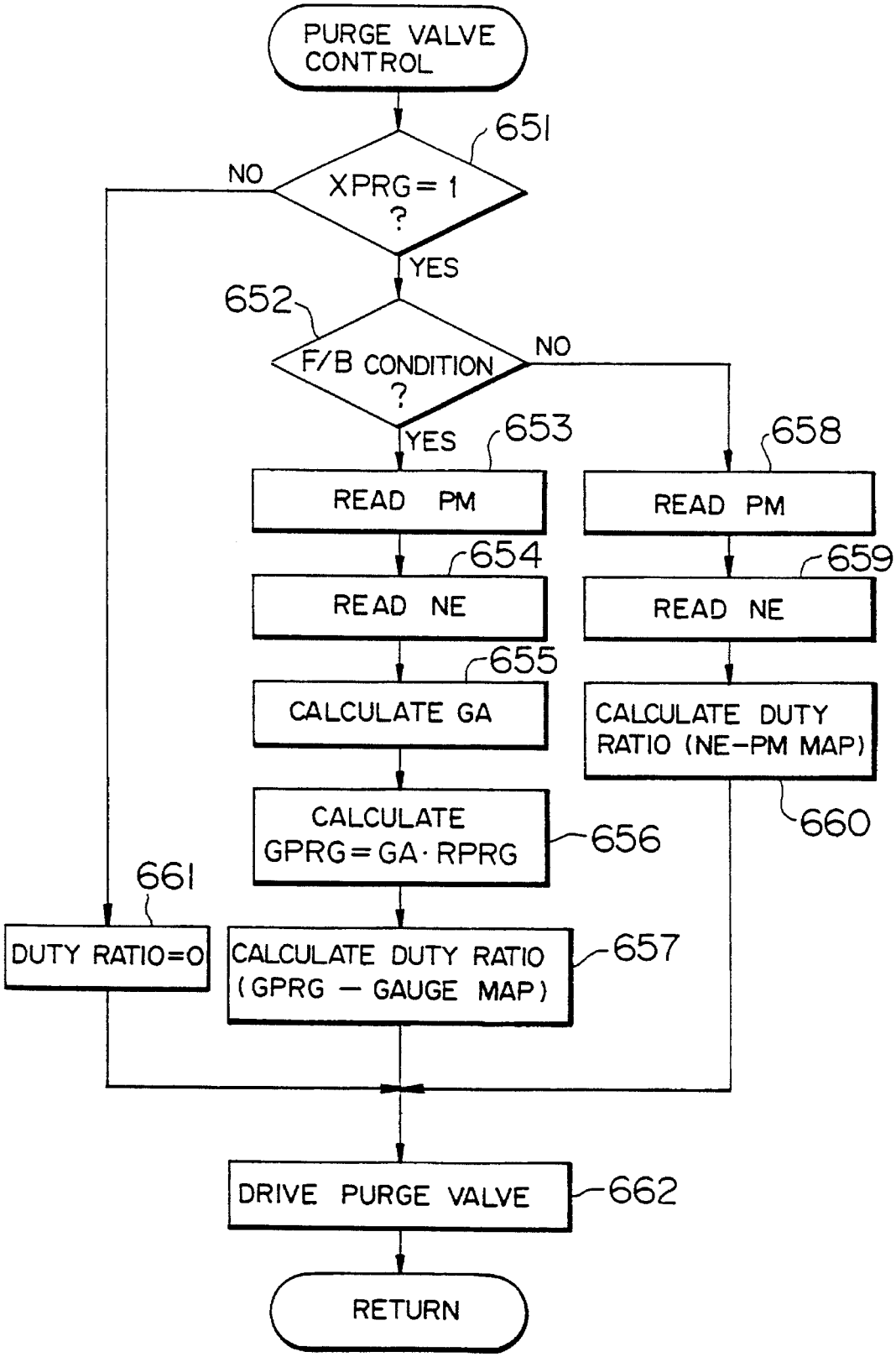
FIG. 11 is a flow chart showing the purge valve control routine as executed by the CPU.

Next follows a description of the purge valve control routine as shown in FIG. 11. This routine is carried out at a time interval of 100 msec by the CPU 21 after processing of the purge VSV correction routine shown in FIG. 10.

As FIG. 11 shows, the CPU 21 in step 651 determines whether the purge execution flag XPRG is set to [1]. In step 652 it determines whether the feedback execution conditions are satisfied. It is also possible to determine whether there is no increase in the high load and whether the oxygen sensor 6 is operating normally. If XPRG=[0], the CPU 21 goes to step 661 and sets the duty ratio at 0% to drive the purge valve 16. IF XPRG=[1] and the feedback conditions are satisfied, the CPU 21 executes the processes in steps 653 through 657. If XPRG=[1] and the feedback conditions are not satisfied, it executes the processes in steps 658 through 660.

To state this in more detail, in steps 653 through 657 the CPU 21 first reads the intake pressure PM in step 653 and reads the engine rotational speed NE in step 654. In the following step 655 the CPU 21 multiplies the designated coefficient Ka and the engine rotational speed NE by the intake air pressure PM to calculate the intake air volume GA, (GA=Ka×NE×PM).

In step 656 the CPU 21 multiplies the above-mentioned intake air volume GA by the purge rate RPRG obtained with the routine in FIG. 6 to calculate the purged flow volume GPRG (GPRG=GA×RPGR). Next, in step 657 the CPU 21 obtains the drive duty ratio of the purge valve 16 employing the duty ratio table in FIG. 12 based on the two parameters of the above-mentioned purged flow volume GPRG and the pressure difference between the air pressure PA and the intake pressure PM (hereafter known as the gauge pressure). If the individual parameter values are the between the table values, the duty ratio is obtained by interpolation.

In steps 658 through 660, the CPU 21 reads the intake pressure PM (absolute pressure) in step 658 and the engine rotational speed NE in step 659. In the following step 660 the CPU 21 obtains the drive duty ratio of the purge valve 16 employing the duty ratio table in FIG. 13 based on the two parameters of the engine rotational speed NE and the intake pressure PM. In addition, based on FIG. 13, the CPU may select a full-closed (duty ratio=0%) or full-open (duty ratio=99.6%) state for the purge valve 16 depending on the engine running state.

After this, in step 662 the CPU-21 drives the purge valve 16 with the above duty ratio. Stated in another way, according to the routine in FIG. 11, when implementing the air/fuel ratio feedback control, open-close control of purge valve 16 is performed in correspondence with the purge rate RPRG and engine running state determined in FIG. 6, i.e., purge control using the table in FIG. 12. Because the purge rate RPRG cannot be operated during open-loop control, the purge valve 16 is controlled with a fixed duty ratio (full-open or full-closed) corresponding to the engine running state, i.e., purge control using the table in FIG. 13.

Figure 16:
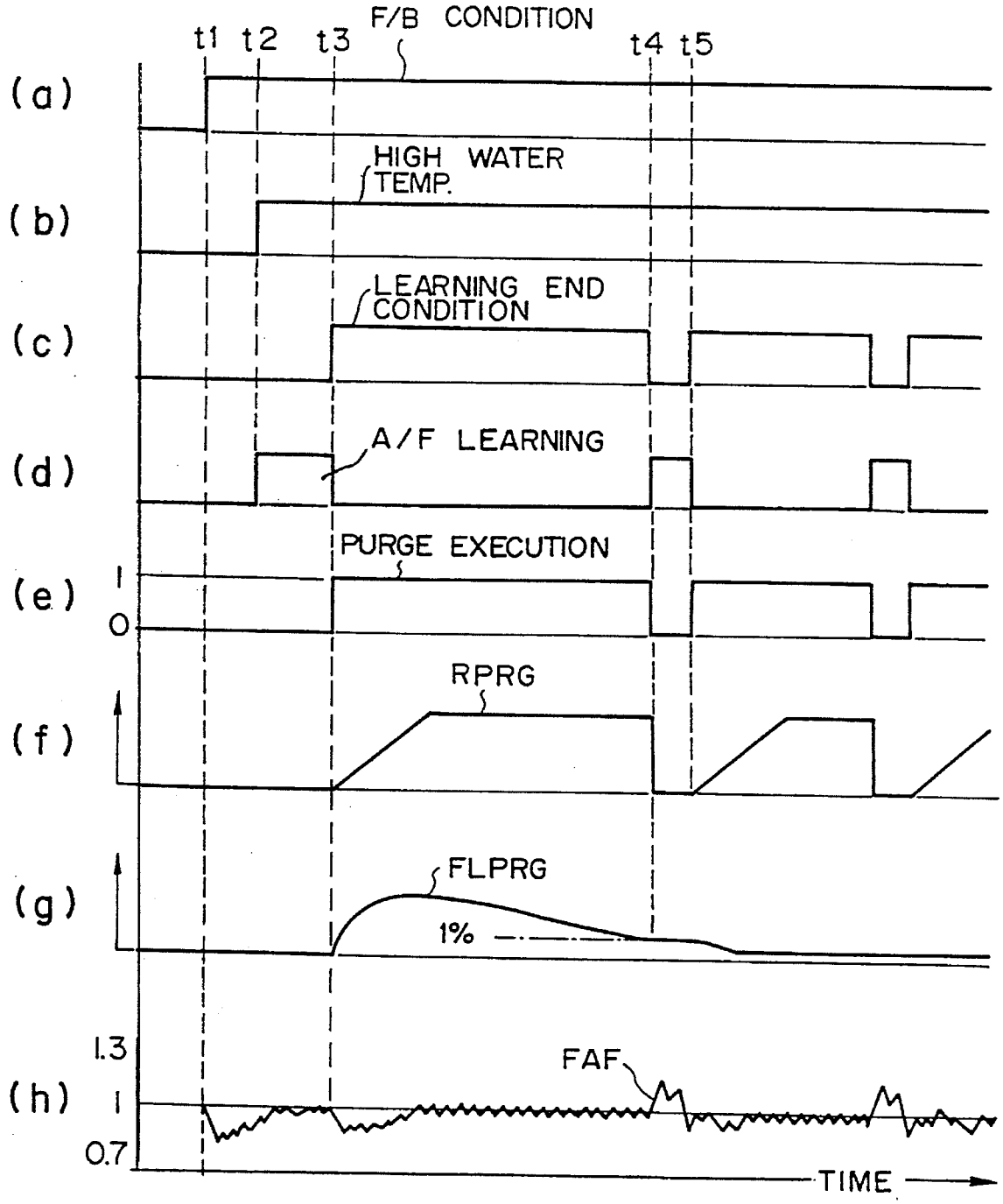
FIGS. 16, a–*h* are timing diagrams describing the operations of the embodiment.
Figure 17:
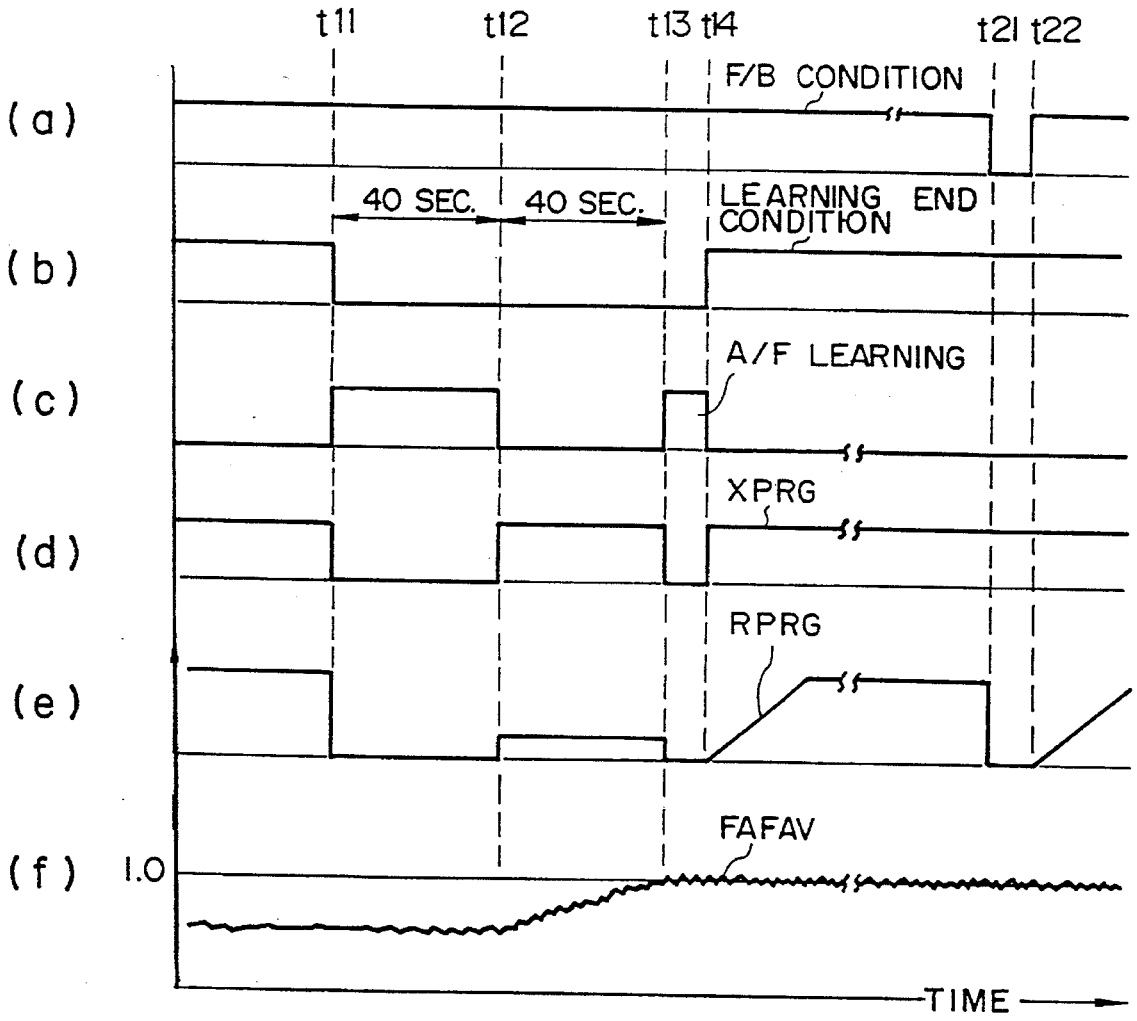
FIGS. 17, *a–f* are timing charts describing the operation of the embodiment.

Next follows explanation of the operation of the CPU 21 according to the above flowchart using the time charts in FIG. 16 and FIG. 17.

FIG. 16 shows the total operation in this air/fuel ratio control. In that figure the time t1 denotes the timing for initial establishment of air/fuel ratio feedback conditions after turning on the power, and time t2 denotes the timing of establishment of the water temperature conditions (THW>80° C). The times t2–t3 and t4–t5 denote the times for executing air/fuel ratio learning according to the routine in FIG. 4.

The following is a description of FIG. 16 in terms of time. First, if the feedback conditions of the air/fuel ratio are established at the time t1 (trace (a) of FIG. 16), the feedback correction coefficient FAF starts to change from the standard value of 1 (trace (h) in FIG. 16). Also, if the water temperature conditions are established at the time t2 (trace (b) of FIG. 16), the air/fuel ratio learning process is started (trace (d) of FIG. 16), so that the feedback correction coefficient FAF converges to 1, which denotes no correction. Then, during the initial learning period of time t2–t3, and with the feedback correction coefficient FAF (smoothed value FAFAV) stabilized within 2% in relation to the standard value, there are 12 skips.

After this, at time t3 the initial learning completion conditions are established, the purge execution flag XPRG is set to [1] (trace (e) of FIG. 16), and the purge valve 16 is opened at the required duty ratio. There is then purging of the adsorbed fuel in the canister 13 so purge control is carried out until the evaporated fuel density FLPRG becomes lean (FLPRG is less than or equal to 1%) and 120 seconds have elapsed for the purge duration time (trace (g) of FIG. 16: period of time t3–t4).

When the time t4 arrives, the air/fuel ratio learning is resumed (trace (d) of FIG. 16) and, with the feedback correction coefficient FAF (smoothed value FAFAV) stabilized within 2% in relation to the standard value, there are 6 skips. Until the end of the skips, i.e., until establishment of the conditions for completing or ending the regular learning), the system conducts air/fuel ratio learning (regular learning period of time t4–t5). After this, purge control and regular learning are repeated in succession.

The time chart in FIG. 17 shows the operation of the system if air/fuel ratio learning still does not finish beyond the required period. In that figure, the time period t11–t14 shows the time in which the learning completion or ending conditions are not satisfied (trace (b) of FIG. 17). The time t12 shows the time in which there is determination of phenomena such as reaching of the learning correction value FLRN to the limit. The times t21–t22 show the time in which the feedback execution conditions are not obtained during purge control.

Stated in another way, if there is reaching of the learning correction value FLRN to the limit and unstable output from the oxygen sensor 6 during execution of the learning process, the feedback correction coefficient FAF (smoothed value FAFAV) cannot be maintained in relation to the standard value of 1.0. Also, at time t12 which is 40 seconds after time t11 (or 60 seconds during the initial learning process), there is determination of generation of phenomena such as the reaching the limit described above. At this time, the purge rate RPRG is set at 1% and the evaporated fuel density FLPRG is held at the value for that time. Also, if the intake air volume GA is unchanging at this time, the purge valve 16 is maintained at a fixed opening. At time t13 which is 40 seconds after time t12 the air/fuel ratio learning process is restarted. After this, at time t14 when the air/fuel ratio stabilizes (trace (f) of FIG. 16) and the learning completion or ending conditions are present, the normal purge control process is started (trace (d) of FIG. 16).

On the other hand, during the time t21–t22 in which the feedback execution conditions are not satisfied during purge control, the air/fuel ratio control goes from feedback or closed-loop control to open-loop control. The purge valve 16 is set either at its full-open or full-closed and the minimum purge volume is obtained. In this way, the rate of evaporated fuel discharge with respect to the intake air volume of the engine may be held constant.

As was described in detail above, with the air/fuel ratio control system in this embodiment, during the time for execution of learning the learning completion conditions were determined based on the deviation of the air/fuel ratio and the target air/fuel ratio. Then, if the learning completion conditions are satisfied, the purge rate RPRG and evaporated fuel density FLPRG in relation to the air/fuel ratio are calculated, and execution of purge control is executed in correspondence with the calculation values. Also, if the learning completion conditions are not satisfied within the required period, it is determined that there is reaching of the learning correction value FLRN to the limit and air/fuel ratio learning is temporarily stopped. Also, forced purge control with a fixed purge ratio RPRG is executed.

Stated in another way, with establishment of learning completion or ending conditions, if the learning correction value FLRN reaches to the upper and lower limits due to unstable factors of the air/fuel ratio during learning execution time with the air/fuel ratio control device, it is no longer possible to carry out evaporated purge until this reaching to the limit is solved. However, with this structure, even if the above-mentioned reaching to the limit takes place, it is possible to definitely carry out evaporated gas purge.

Figure 15:
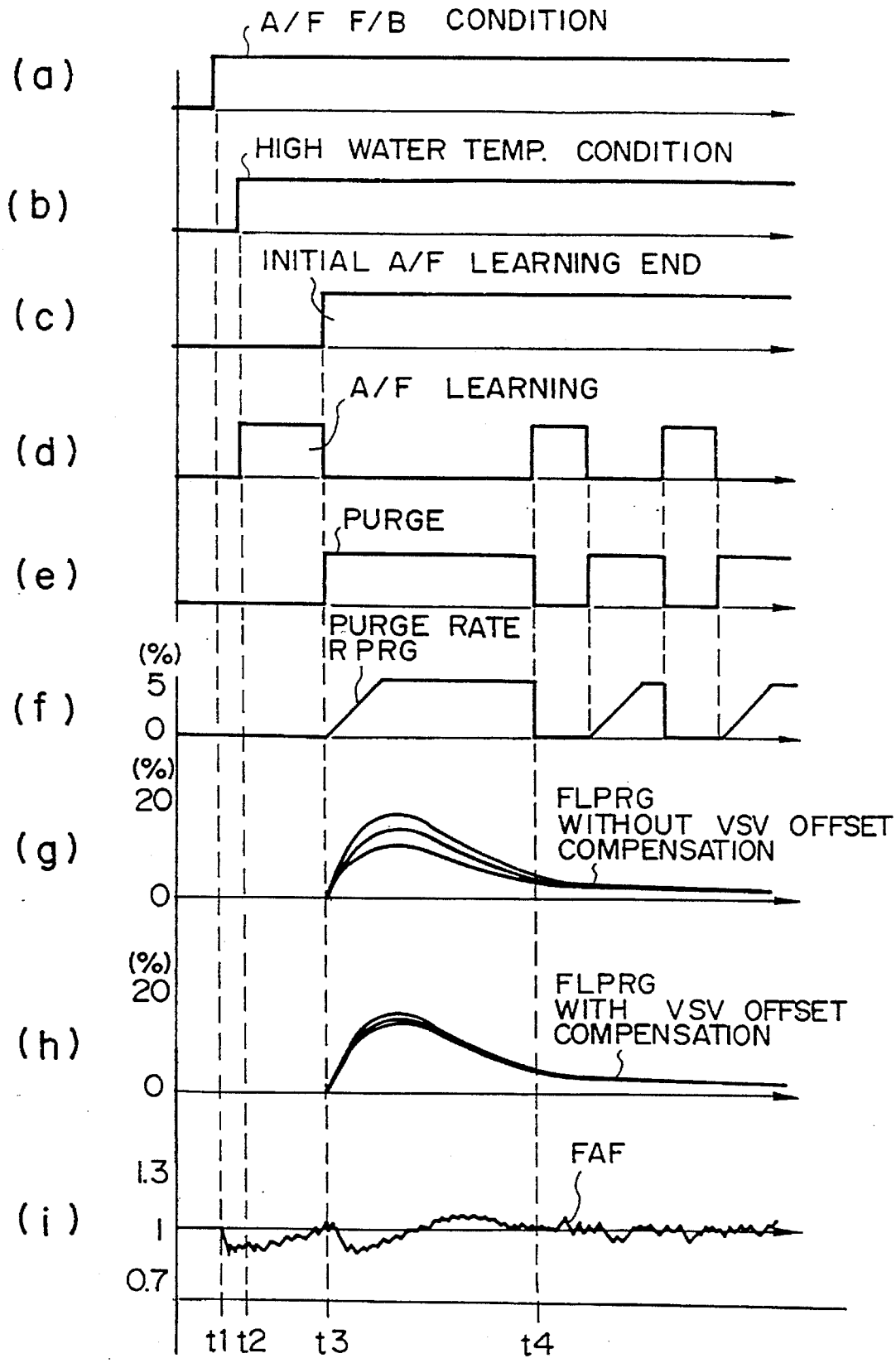
FIGS. 15, *a–i* are timing diagrams showing changes in the various signals when the various control routines are carried out for the air/fuel ratio control system of the internal combustion engine in the embodiment.

FIG. 15 is a timing chart showing the changes in the different signals when the purge VSV correction routine is conducted in the air/fuel ratio control system of the engine shown in FIG. 10.

First the air/fuel ratio F/B control routine in FIG. 4 is executed. The air/fuel ratio F/B conditions are established in the time t1 shown in trace (a) of FIG. 15 and the FAF value which is the air/fuel ratio feedback coefficient of trace (i) in FIG. 15 starts from a standard value of 1. Next, there is execution of the A/F learning control routine in FIG. 5. If the cooling water temperature condition is established at the time t2 as shown in trace (b) of FIG. 15, A/F learning as in trace (d) of FIG. 15 is executed. The initial A/F learning completion or ending conditions at the time t3 shown in trace (c) of FIG. 15 are established, after which the purge implementation flag in trace (e) of FIG. 15 rises and execution of the purge rate RPRG control as shown in trace (f) of FIG. 15 is begun. As the above shows, the purge VSV control shown in FIG. 10 is carried out in relation to the purge VSV 16 which is the flow control valve in this embodiment, and offset correction is carried out. As a result, as shown in trace (h) of FIG. 15, the evaporated gas density value FLPRG shows little difference among the separate sections, and changes at about the same rate. Thus, as shown in trace (i) of FIG. 15, the FAF value (which is the air/fuel ratio feedback coefficient) is within ±2% around the standard value 1 in carrying out six skips. Up until the time t4 in trace (f) of FIG. 15 where it is determined that the evaporated gas density has become lean, there is control of the purge rate RPRG. The evaporated gas density value FLPRG shown in trace (g) of FIG. 15 shows the transition when, for the sake of comparison, there is no offset correction for the original flow control valve. Due to the influence of the different characteristic changes unique to the individual sections caused in production, assembly and change over time of the flow control meter, the evaporated gas density value FLPRG has large differences. After this, there is execution once again in succession of A/F learning in trace (d) of FIG. 15 and purge rate RPRG control in trace (f) of FIG. 15 so that the FAF value which is the air/fuel ratio feedback coefficient is not far removed from the standard value 1.

Figure 18:
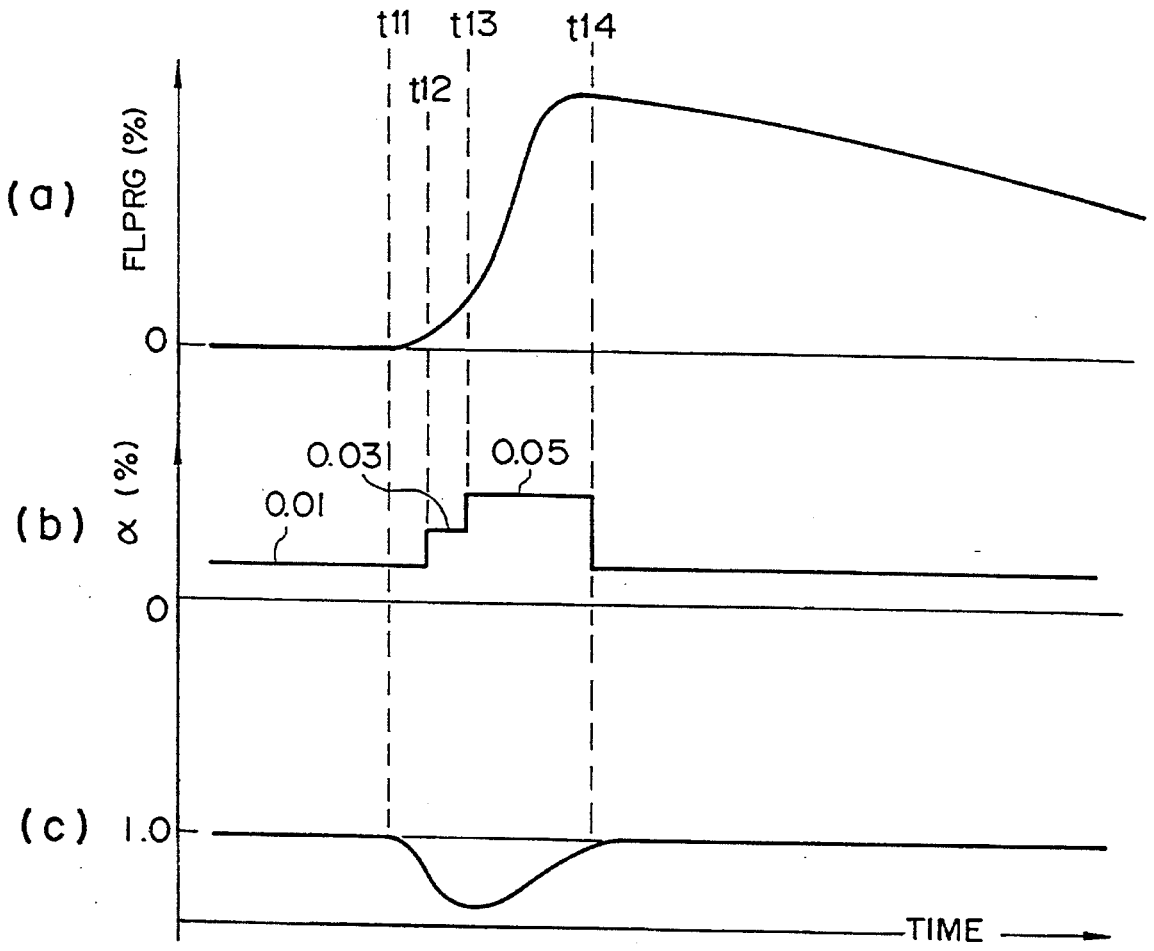
FIGS. 18, *a–c* are timing charts describing the operation of the embodiment.

The time chart in FIG. 18 shows in detail the change of the evaporated gas density FLPRG upon carrying out the evaporated gas density calculation processing shown in FIGS. 7 and 8.

In FIG. 18, at time t11 when change of the evaporated gas density FLPRG has started (same as time t3 in FIG. 16), the density renewal width $\alpha$=0.01% (trace (b) of FIG. 18). After time t11 the density renewal width $\alpha$ is renewed in correspondence with the change amount of the evaporated gas density FLPRG. As shown in the figure, at time t12 $\alpha$ equals 0.03%, and at time t13 $\alpha$ equals 0.05%. At time t14 when the evaporated gas density FLPRG (estimated density value) reaches the actual density value, the density renewal width $\alpha$ returns to 0.01%. Afterward, because changes in the evaporated gas density FLPRG are relatively small, the density renewal width $\alpha$ is maintained at 0.01% and the evaporated gas density FLPRG (trace (a) of FIG. 18) is set in correspondence to the change amount when there is a change in density.

Also, the smoothed value FAFAV of the feedback correction coefficient (trace (c) of FIG. 18) tends toward a rich value for a while after time t11. However, upon reaching the actual value of the evaporated gas density FLPRG it is converged at the standard value of 1.0.

As was described above in detail, with the air/fuel ratio control system in this embodiment, the fuel injection amount from the injector 4 was corrected in terms of the feedback correction coefficient FAF, the learning correction value FLRN and the purge correction coefficient FPRG (=FL- PRG×RPRG) (steps 502–504 in FIG. 9). Also, during the opening period of the purge valve 16, i.e., the period where the purge execution flag XPRG=[1], if the air/fuel ratio tends toward rich, the evaporated gas density FLPRG is increased by the amount of the density renewal width α. If the air/fuel ratio tends toward lean, the evaporated gas density FLPRG is decreased by the amount of the density renewal width α (steps 313–317 in FIG. 7). Also, the larger the change rate β of the evaporated gas density FLPRG, the larger the value to which the density renewal width α is set (steps 404–408 of FIG. 8).

Stated in another way, in correcting the fuel injection volume in relation to the evaporated gas density FLPRG, if there is a discrepancy between the evaporated gas density FLPRG (estimated value) and the actual density value, correction of fuel injection will be insufficient, leading to deviations in the air/fuel ratio. However, with the structure described above, by increasing or decreasing the evaporated gas density FLPRG in relation to a rich or lean concentration of the air/fuel ratio, it is possible to achieve both the appropriate density estimation and accurate air/fuel ratio control.

Also, with the structure described above, it is possible to measure the extent of the deviation of the evaporated gas density value FLPRG from the actual density value using the change rate β of the evaporated gas density FLPRG. By setting the density renewal width α in correspondence to the change rate β, even if the evaporated gas density changes rapidly during engine start or fueling, for example, it is possible for the evaporated gas density FLPRG to quickly achieve the actual density value, thus increasing the estimation accuracy for the evaporated gas density FLPRG. At this time, even in the case of full evaporation adsorption in the canister 13 (saturation state for adsorption of the evaporated gas), it is possible to quickly and accurately estimate the evaporated gas density FLPRG. With increased accuracy of the evaporated gas density FLPRG, it is also possible to quickly eliminate temporary disturbances in the air/fuel ratio arising from sudden changes in the evaporated gas density.

Figure 19:
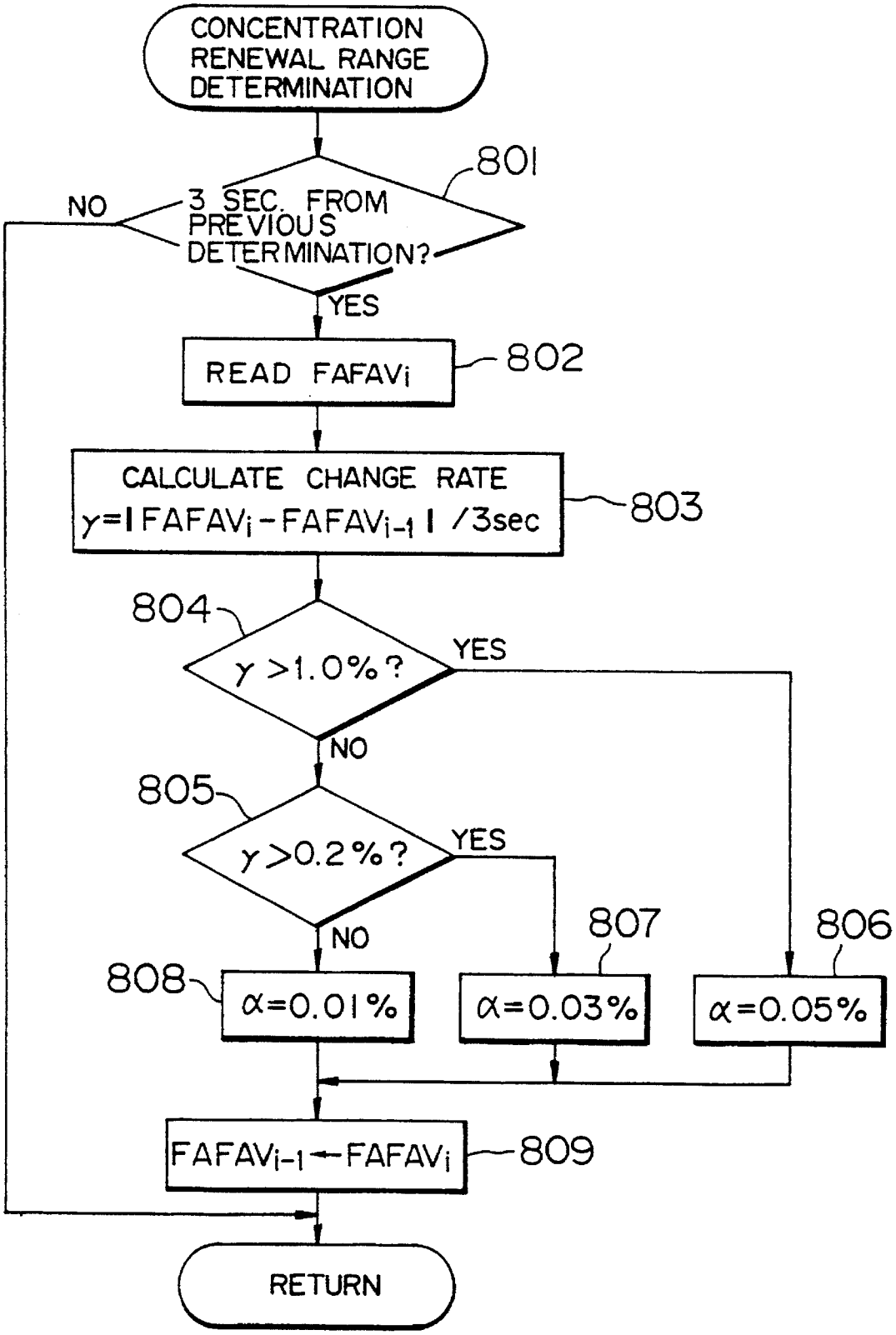
FIG. 19 is a flow chart representing a modification of the flow chart in FIG. 8 of the first embodiment of the present invention.

Next follows a description of the flow chart in FIG. 19 which shows a modification (another embodiment) in which the foregoing first embodiment described above with reference to FIG. 8 is changed partially.

FIG. 19 is a routine corresponding to the density renewal width setting routine in FIG. 8 described above. In step 801 of FIG. 19, the CPU 21 determines whether the required time (three seconds in this embodiment) has elapsed since determining the previous density renewal width α. If three seconds have not yet elapsed, the routine is terminated there. If three seconds have elapsed, the CPU 21 proceeds to step 802 and obtains the smoothed value $FAFAV_i$ of the feedback correction coefficient FAF at that time. In the following step 803 the CPU 21 calculates the change rate γ (gamma) of the smoothed value FAFAV from the present smoothed value $FAFAV_i$ and the previous smoothed value $FAFAV_{i-1}$ ($\tau=|FAFAV_i-FAFAV_{i-1}|/3$ sec).

Afterward, in steps 804 through 808 the CPU 21 derives the density renewal width α (%) corresponding to the value of the change rate γ. Stated in another way, if γ is greater than 10% the CPU 21 sets α=0.05% in step 806. If γ is less than or equal to 1.0% and greater than 0.2%, the CPU 21 determines α=0.03% in step 807. If τ is less than or equal to 0.2% the CPU 21 sets α=0.01% in step 808. Stated in another way, the greater the value of the change rate γ of the smoothed value FAFAV, the greater the CPU 21 considers the deviation of the evaporated gas density FLPRG (estimated density value)from the actual density value, and thus sets a large value for the density renewal width α. After this, in step 809 the CPU 21 stores the present smoothed value $FAFAV_i$ as the previous smoothed value $FAFAV_{i-1}$ in the RAM 26 to complete the routine.

In other words, according to this routine in FIG. 19, as is the case with the first embodiment described above, even in cases where the evaporated gas density FLPRG changes suddenly during engine start or fueling, for example, the density renewal width α is set in accordance with those conditions. As a result, it is possible to quickly bring the evaporated gas density FLPRG (estimated density value) in line with the actual density value, thus increasing the accuracy of the evaporated gas density FLPRG and realizing accurate air/fuel ratio control.

Moreover, this invention is not limited to the foregoing embodiments described above and can be implemented in the following state.

In the routines described above in FIG. 8 and FIG. 19, there is derivation of the evaporated gas density FLPRG and the change rate of the smoothed value FAFAV in a three-second interval in order to calculate the change rates β and γ and the density renewal width α. However, if the period is shortened for obtaining the above change amounts, it is possible to increase the accuracy of the calculation of the evaporated gas density FLPRG. It is also possible to set the density renewal width α each time according to the amount of change in each routine.

In the embodiment described above, there was setting of the density renewal width α in three stages in relation to the evaporated gas density FLPRG and the change rate β of the smoothed value FAFAV. However, it is also possible to set the density renewal width α in 4 stages or more. For example, using the equation α=Kb×β (where Kb is a coefficient), it is possible to set the density renewal width α without steps. In such a case, if an upper and lower limit are established for the density renewal width α, it is possible to avoid overshoot.

Figure 20:
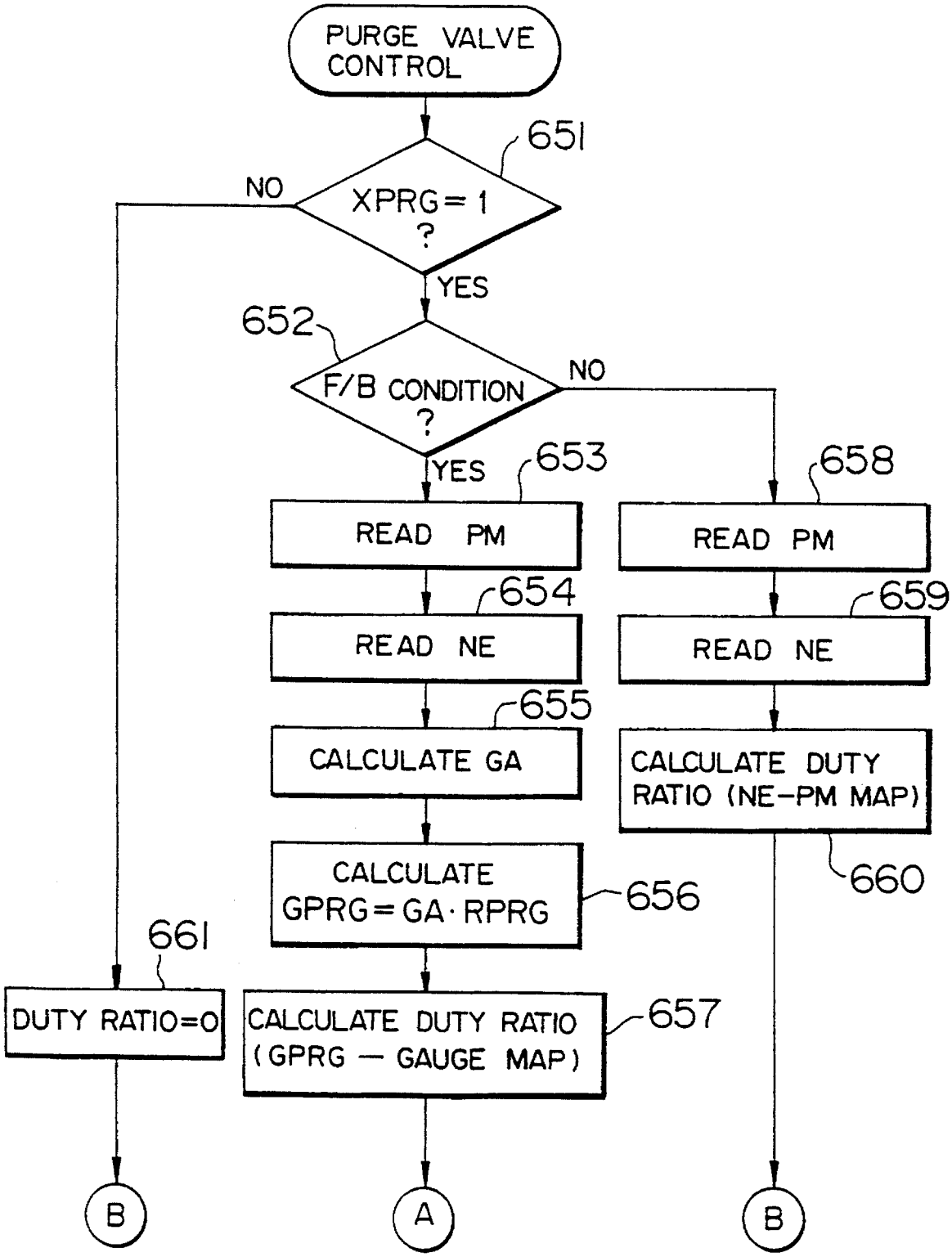
FIG. 20 is a flow chart presenting a modification of the flow chart in FIG. 10 of the first embodiment of the present invention.
Figure 21:
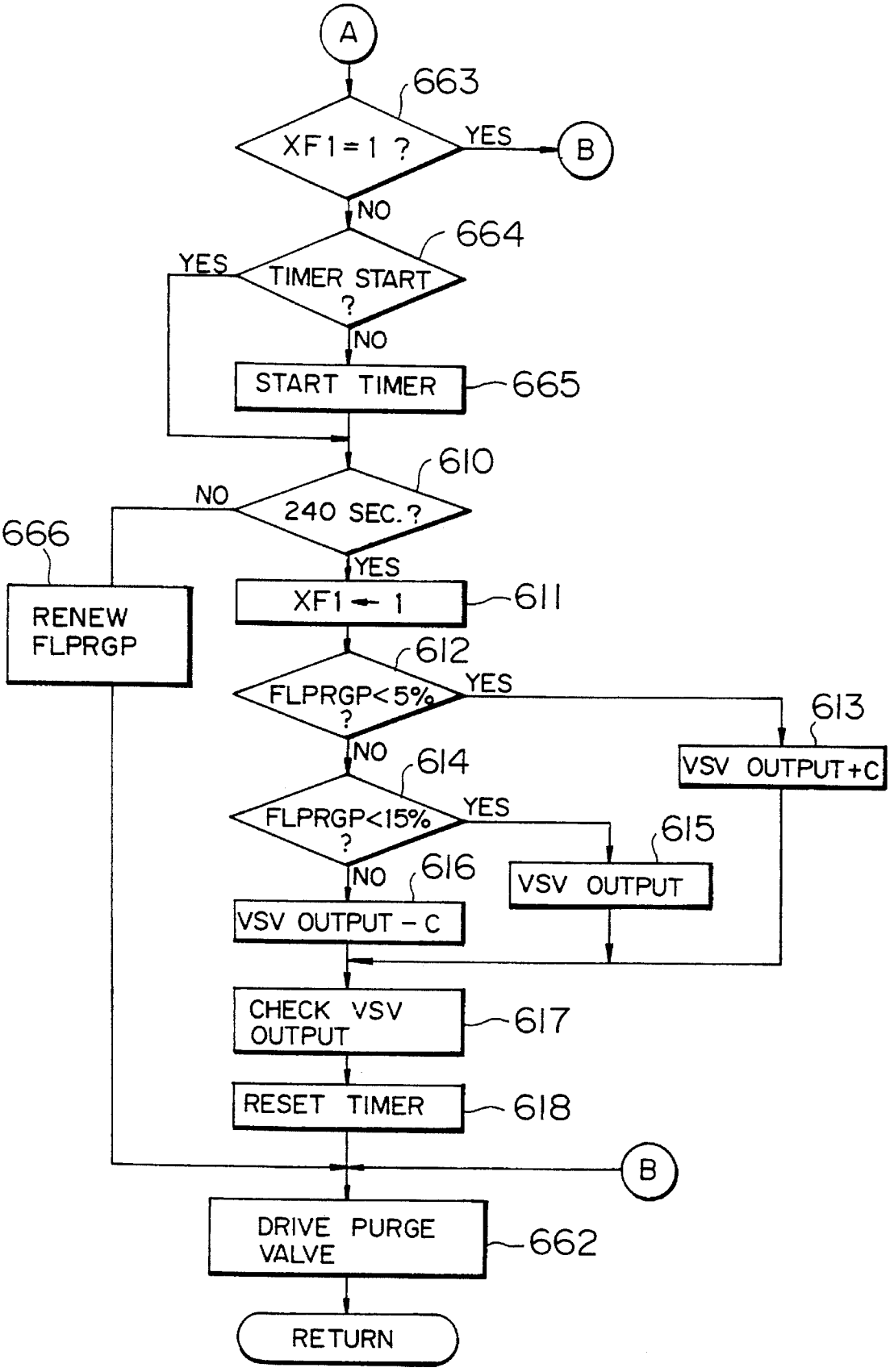
FIG. 21 is a flow chart presenting a modification of the flow chart in FIG. 11 of the first embodiment of the present invention.

Also, instead of executing the processes in FIG. 10 and 11 of the first embodiment, it is also possible to execute the processes shown in FIGS. 20 and 21. In the steps for executing processes in FIGS. 20 and 21 which are similar to those in FIGS. 10 and 11, the same reference numerals are assigned and explanation of the same is omitted for brevity. FIGS. 20 and 21 are executed at every 100 ms by the CPU 21. In addition, when the ignition switch is turned on, there is initialization where the tolerance correction flag XF=0 and the evaporation density peak value FLPRGP=0.

If these processes are executed, the processes described in FIG. 11 in steps 651 to 661 are also executed. In step 657, the duty ratio of the signal emitted to the purge VSV is derived. Then, step 663 in FIG. 21 determines whether the tolerance correction flag XF1 is 1. Because it is initially XF=0, the process goes to step 664. Step 664 determines whether the timer has started to measure the time since this process was executed. If the timer has not yet started, the timer is started in step 665 before proceeding to step 610. If the timer has started, the process proceeds directly to step 610.

Step 610 determines from the timer value whether 240 seconds have elapsed since execution of this process. If 240 seconds have not elapsed, the process goes to step 666 to execute renewal processing of the peak value FLPRGP of the evaporated gas density. More specifically, the system compares the present evaporated gas density FLPRG and the evaporated gas density peak value FLPRGP. If the present evaporated gas density FLPRG is larger, the renewed evaporated gas density peak value FLPRGP is set to that value.

The process then goes to step 662 to execute purge valve drive processing and then to end this process.

Also, if it is determined in step 610 that 240 seconds have elapsed, the processes in steps 611 to 618 are executed, followed by execution tolerance correction processing for the purge VSV 16. Once tolerance correction processing for the purge VSV 16 has been carried out, in step 611 the tolerance correction flag XF1 is set at 1 so that the process proceeds to step 662 after step 663 so that there is no tolerance correction processing until the ignition is turned on again.

Finally, in the foregoing description of the present invention, the invention has been disclosed with reference to specific embodiments thereof. It will, however, be evident that various modification and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. An air/fuel ratio control system for an internal combustion engine in which evaporated fuel generated in a fuel tank of the engine is stored in a canister and then discharged from the canister together with air as a mixture via a discharge route connected to an intake inlet of the engine, the system comprising:

an air/fuel ratio detector detecting an air/fuel ratio of an air/fuel mixture in an intake pipe of the engine based on exhaust gas in an exhaust pipe of the engine;

a flow control valve located in the discharge route which changes a flow rate of the evaporated fuel responsive to an offset drive signal;

deviation detection means for detecting, responsive to a change in the evaporated fuel flow rate caused by the flow control valve, a deviation of the air/fuel ratio detected by the air/fuel ratio detector from a target air/fuel ratio;

density calculation means for calculating a density of the evaporated fuel based on the deviation detected by the deviation detection means; and offsetting means for generating the offset drive signal based on the density of the evaporated fuel calculated by the density calculation means and on a drive signal corresponding to the calculated density of the evaporated fuel, wherein the offsetting means generates the offset drive signal based on a maximum evaporated fuel density value calculated by the density calculation means and a drive signal corresponding to the maximum evaporate fuel density value, and wherein the offsetting means further generates, when the maximum evaporated fuel density value is smaller than a prescribed value, the offset drive signal to produce a larger opening of the flow control valve relative to the drive signal; and the offsetting means further generates, when the maximum evaporated fuel density value is larger than the prescribed value, the offset drive signal to produce a smaller opening of the flow control valve relative to the drive signal.

2. An air/fuel ratio control system for an internal combustion engine in which evaporated fuel generated in a fuel tank of the engine is stored in a canister and then discharged from the canister together with air as a mixture via a discharge route connected to an intake inlet of the engine, the system comprising:

an air/fuel ratio detector detecting an air/fuel ratio of an air/fuel mixture in an intake pipe of the engine based on exhaust gas in an exhaust pipe of the engine;

a flow control valve located in the discharge route which changes a flow rate of the evaporated fuel responsive to an offset drive signal;

deviation detection means for detecting, responsive to a change in the evaporated fuel flow rate caused by the flow control valve, a deviation of the air/fuel ratio detected by the air/fuel ratio detector from a target air/fuel ratio;

density calculation means for calculating a density of the evaporated fuel based on the deviation detected by the deviation detection means; and offsetting means for generating the offset drive Signal based on the density of the evaporated fuel calculated by the density calculation means and on a drive signal corresponding to the calculated density of the evaporated fuel, wherein the offsetting means generates the offset drive signal based on a maximum evaporated fuel density value calculated by the density calculation means and a drive signal corresponding to the maximum evaporate fuel density value, and wherein the offsetting means generates the offset drive signal which is set smaller as the drive signal to the flow control valve is larger.

3. An air/fuel ratio control system for an internal combustion engine, the system comprising:

a fuel tank for holding fuel for the engine;

a canister to adsorb evaporated fuel generated in the fuel tank;

a switching valve, having an open state and a closed state, to guide evaporated gas adsorbed by the canister from the canister as a mixture through a discharge route to an intake pipe of the engine;

a valve control means to selectively open and close the switching valve;

an injector for injecting fuel held in the fuel tank into the engine responsive to a fuel injection amount represented by a fuel injector drive signal;

injection volume calculation means for calculating the fuel injection amount responsive to running conditions of the engine;

an air/fuel ratio sensor to detect an air/fuel ratio of the mixture supplied to the intake pipe of the engine;

density estimation means, responsive to a renewal width, for, when the switching valve is opened by the valve control means, calculating an estimated density value of the evaporated fuel to be larger than a previous value if the air/fuel ratio sensor detects that the air/fuel ratio is rich, and for calculating the estimated density value of the evaporated fuel to be smaller than the previous value if the air/fuel ratio sensor detects that the air/fuel ratio is lean;

renewal width setting means for setting the renewal width responsive to a magnitude of a deviation of the estimated density value calculated by the density estimation means from an actual density value;

injection volume correction means for calculating a corrected injection amount from the fuel injection amount calculated by the injection volume calculation means responsive to the estimated evaporated fuel density value calculated by the density estimation means, and to a deviation between the air/fuel ratio according to the air/fuel ratio sensor and a target air/fuel ratio; and injector control means for generating the fuel injector drive signal based on the corrected fuel injection amount.

4. The air/fuel ratio control system according to claim 3, further comprising:

density change rate calculation means for calculating a rate of change of the estimated evaporated fuel density value;

wherein the renewal width setting means makes the renewal width larger responsive to an increase in the rate of change calculated by the density change rate calculation means.

5. The air/fuel ratio control system according to claim 3, further comprising:

feedback correction coefficient calculation means for calculating a feedback correction coefficient to decrease the deviation between the air/fuel ratio detected by the air/fuel ratio sensor and the target air/fuel ratio;

wherein the renewal width setting means makes the renewal width larger responsive to an increase in the rate of change calculated by the feedback correction coefficient calculation means.

6. An air/fuel ratio control system for an internal combustion engine in which evaporated fuel generated in a fuel tank of the engine is stored in a canister and then discharged from the canister together with air as a mixture via a discharge route connected to an intake inlet of the engine, the system comprising:

an air/fuel ratio detector detecting an air/fuel ratio of an air/fuel mixture in an intake pipe of the engine based on exhaust gas in an exhaust pipe of the engine;

a flow control valve located in the discharge route which changes a flow rate of the evaporated fuel responsive to an offset drive signal;

deviation detection means for detecting, responsive to a change in the evaporated fuel flow rate caused by the flow control valve, a deviation of the air/fuel ratio detected by the air/fuel ratio detector from a target air/fuel ratio;

density calculation means for calculating a density 0f the evaporated fuel based on the deviation detected by the deviation detection means; and offsetting means for generating the offset drive signal based on the density of the evaporated fuel calculated by the density calculation means and on a drive signal corresponding to the calculated density of the evaporated fuel, wherein the offsetting means generates the offset drive signal based on a maximum evaporated fuel density value calculated by the density calculation means and a drive signal corresponding to the maximum evaporate fuel density value, and further comprising:

an injector for injecting fuel held in the fuel tank into the engine;

air/fuel ratio learning means for carrying out air/fuel ratio learning to determine air/fuel ratio parameters and for correcting a deviation between an air/fuel ratio detected by the air/fuel ratio detector and a target air/fuel ratio;

learning parameter determining means for determining conditions for completion of air/fuel ratio learning based on the deviation;

first valve control means for controlling the flow control valve responsive to learning completion conditions determined by the learning parameter determining means;

second valve control means for suspending learning by the air/fuel ratio learning means and for opening the flow control valve if the learning parameter determining means to determine learning conditions within a prescribed time; and air/fuel ratio control means for controlling fuel injection volume to the engine based on the air/fuel ratio parameters determined by the air/fuel ratio learning means so that the air/fuel ratio detected by the air/fuel ratio detector converges on the target air/fuel ratio.

7. The air/fuel ratio control system according to claim 6, wherein:

the first valve control means controls the flow control valve to provide an effective opening corresponding to behavior of the evaporated fuel and engine running conditions upon determination of the air/fuel ratio parameters; and the first valve control means comprises means for selectively controlling the flow control valve to provide the effective opening corresponding to the engine running conditions when the air/fuel ratio parameters are not determined within the prescribed time.

8. The air/fuel ratio control system according to claim 6, wherein the second valve control means selectively controls the flow control valve so that a rate at which the evaporated fuel is discharged is set in relation to an intake air volume of the engine, thereby obtaining a minimum discharge volume of evaporated fuel.

9. The air/fuel ratio control system according to claim 8, wherein:

the first valve control means controls the flow control valve to provide an effective opening corresponding to behavior of the evaporated fuel and engine running conditions upon determination of the air/fuel ratio parameters; and the first valve control means comprises means for selectively controlling the flow control valve to provide the effective opening corresponding to the engine running conditions when the air/fuel ratio parameters are not determined within the prescribed time.

10. An air/fuel ratio control system for an internal combustion engine in which evaporated fuel generated in a fuel tank of the engine is stored in a canister and then discharged from the canister together with air as a mixture via a discharge route connected to an intake inlet of the engine, the system comprising:

an air/fuel ratio detector detecting an air/fuel ratio of an air/fuel mixture in an intake pipe of the engine based on exhaust gas in an exhaust pipe of the engine;

a flow control valve located in the discharge route which changes a flow rate of the evaporated fuel responsive to an offset drive signal;

deviation detection means for detecting, responsive to a change in the evaporated fuel flow rate caused by the flow control valve, a deviation of the air/fuel ratio detected by the air/fuel ratio detector from a target air/fuel ratio;

density calculation means for calculating a density of the evaporated fuel based on the deviation detected by the deviation detection means; and offsetting means for generating the offset drive signal based on the density of the evaporated fuel calculated by the density calculation means and on a drive signal corresponding to the calculated density of the evaporated fuel, wherein the offsetting means generates the offset drive signal based on a maximum evaporated fuel density value calculated by the density calculation means and a drive signal corresponding to the maximum evaporate fuel density value, and wherein the maximum evaporated fuel density value is a maximum evaporated fuel density value occurring during a prescribed time after starting the engine.

11. The air/fuel ratio control system according to claim 10, wherein:

the offset drive signal drives the flow control valve according to a duty cycle; and the offsetting means generates the offset drive signal base on the evaporated fuel density calculated by the density calculation means and the duty cycle of the drive signal corresponding to the evaporated fuel density calculated by the density calculation means.

12. The air/fuel ratio control system according to claim 10, further comprising:

drive signal generating means for generating the drive signal responsive to a difference in pressure between atmospheric air pressure and intake air pressure, and further responsive to a flow volume of the evaporated fuel in the discharge route.

13. The air/fuel ratio control system according to claim 10, wherein the density calculation means, responsive to a renewal width, calculates the density of the evaporated fuel to be larger than a previous value if the air/fuel ratio detector detects that the air/fuel ratio is rich, and calculates the density of the evaporated fuel to be smaller than the previous value if the air/fuel ratio detector detects that the air/fuel ratio is lean, the system further comprising:

an injector for injecting fuel held in the fuel tank into the engine responsive to a fuel injection amount represented by a fuel injector drive signal;

injection volume calculation means for calculating the fuel injection amount responsive to running conditions of the engine;

renewal width setting means for setting the renewal width responsive to a magnitude of a deviation of the density calculated by the density calculation means from an actual density value;

injection volume correction means for calculating a corrected injection amount from the fuel injection amount calculated by the injection volume calculation means responsive to the evaporated fuel density calculated by the density calculation means, and to the deviation between the air/fuel ratio according to the air/fuel ratio detector and the target air/fuel ratio calculated by the deviation detection means; and injector control means for generating the fuel injector drive signal based on the corrected fuel injection amount.

14. The air/fuel ratio control system according to claim 13, further comprising:

density change rate calculation means for calculating a rate of change of the evaporated fuel density calculated by the density calculation means;

wherein the renewal width setting means makes the renewal width larger responsive to an increase in the rate of change calculated by the density change rate calculation means.

15. The air/fuel ratio control system according to claim 13, further comprising:

feedback correction coefficient calculation means for calculating a feedback correction coefficient to decrease the deviation between the air/fuel ratio detected by the air/fuel ratio sensor and the target air/fuel ratio;

wherein the renewal width setting means makes the renewal width larger responsive to an increase in the rate of change calculated by the feedback correction coefficient calculation means.

16. An air/fuel ratio control system for an internal combustion engine, the system comprising:

a fuel tank for holding fuel for the engine;

a canister to adsorb evaporated fuel generated in the fuel tank;

a switching valve, having an open state and a closed state, to guide evaporated fuel adsorbed by the canister and air from the canister through a discharge route to an intake pipe of the engine;

an injector for injecting fuel held in the fuel tank into the engine responsive to a fuel injection amount represented by a fuel injector drive signal;

an air/fuel ratio sensor detecting an air/fuel ratio of an air/fuel mixture supplied to the engine through the intake pipe, based on an exhaust gas in an exhaust pipe of the engine;

air/fuel ratio learning means for carrying out air/fuel ratio learning to determine air/fuel ratio parameters and for correcting a deviation between an air/fuel ratio detected by the air/fuel ratio sensor and a target air/fuel ratio;

learning parameter determining means for determining conditions for completion of air/fuel ratio learning based on the deviation;

first valve control means for selectively opening and closing the switching valve responsive to learning completion conditions determined by the learning parameter determining means;

second valve control means for suspending learning by the air/fuel ratio learning means and for opening the switching valve if the learning parameter determining means fails to determine learning conditions within a prescribed time; and air/fuel ratio control means for controlling fuel injection volume to the engine based on the air/fuel ratio parameters determined by the air/fuel ratio learning means so that the air/fuel ratio detected by the air/fuel ratio sensor converges on the target air/fuel ratio.

17. The air/fuel ratio control system according to claim 16, wherein:

the first valve control means controls the switching valve to provide an effective opening corresponding to behavior of the evaporated fuel and engine running conditions upon determination of the air/fuel ratio parameters; and the first valve control means comprises means for selectively controlling the switching valve to provide the effective opening corresponding to the engine running conditions when the air/fuel ratio parameters are not determined within the prescribed time.

18. The air/fuel ratio control system according to claim 16, wherein the second valve control means selectively controls the switching valve so that a rate at which the evaporated fuel is discharged is set in relation to an intake air volume of the engine, thereby obtaining a minimum discharge volume of evaporated fuel.

19. The air/fuel ratio control system according to claim 18, wherein:

the first valve control means controls the switching valve to provide an effective opening corresponding to behavior of the evaporated fuel and engine running conditions upon determination of the air/fuel ratio parameters; and the first valve control means comprises means for selectively controlling the switching valve to provide the effective opening corresponding to the engine running conditions when the air/fuel ratio parameters are not determined within the prescribed time.

20. The air/fuel ratio control system according to claim 16, further comprising:

injection volume calculation means for calculating the fuel injection amount responsive to running conditions of the engine;

density estimation means, responsive to a renewal width, for, when the switching valve is opened by the first valve control means, calculating an estimated density value of the evaporated fuel to be larger than a previous value if the air/fuel ratio sensor detects that the air/fuel ratio is rich, and for calculating the estimated density value of the evaporated fuel to be smaller than the previous value if the air/fuel ratio sensor detects that the air/fuel ratio is lean;

renewal width setting means for setting the renewal width responsive to a magnitude of a deviation of the estimated density value calculated by the density estimation means from an actual density value;

injection volume correction means for calculating a corrected injection amount from the fuel injection amount calculated by the injection volume calculation means responsive to the estimated evaporated fuel density value calculated by the density estimation means, and to the deviation between the air/fuel ratio according to the air/fuel ratio sensor and the target air/fuel ratio; wherein the air/fuel ratio control means controls the fuel injection volume based on the corrected fuel injection amount.

21. The air/fuel ratio control system according to claim 20, further comprising:

density change rate calculation means for calculating a rate of change of the estimated evaporated fuel density value;

wherein the renewal width setting means makes the renewal width larger responsive to an increase in the rate of change calculated by the density change rate calculation means.

22. The air/fuel ratio control system according to claim 20, further comprising:

feedback correction coefficient calculation means for calculating a feedback correction coefficient to decrease the deviation between the air/fuel ratio detected by the air/fuel ratio sensor and the target air/fuel ratio;

wherein the renewal width setting means makes the renewal width larger responsive to an increase in the rate of change calculated by the feedback correction coefficient calculation means.

* * * * *